US010907866B2

(12) United States Patent
Matsuda et al.

(10) Patent No.: US 10,907,866 B2
(45) Date of Patent: Feb. 2, 2021

(54) REFRIGERANT CYCLE APPARATUS AND AIR CONDITIONING APPARATUS INCLUDING THE SAME

(71) Applicant: Mitsubishi Electric Corporation, Tokyo (JP)

(72) Inventors: Takuya Matsuda, Tokyo (JP); Takeshi Hatomura, Tokyo (JP); Yutaka Aoyama, Tokyo (JP); Takumi Nishiyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 53 days.

(21) Appl. No.: 16/096,714

(22) PCT Filed: Jul. 8, 2016

(86) PCT No.: PCT/JP2016/070219
§ 371 (c)(1),
(2) Date: Oct. 26, 2018

(87) PCT Pub. No.: WO2018/008139
PCT Pub. Date: Jan. 11, 2018

(65) Prior Publication Data

US 2019/0137148 A1 May 9, 2019

(51) Int. Cl.
*F25B 13/00* (2006.01)
*F25B 5/00* (2006.01)
(Continued)

(52) U.S. Cl.
CPC ..... *F25B 13/00* (2013.01); *F25B 5/00* (2013.01); *F25B 6/00* (2013.01); *F25B 6/02* (2013.01);
(Continued)

(58) Field of Classification Search
CPC .... F25B 13/00; F25B 5/00; F25B 6/00; F25B 6/02; F25B 2313/02531; F25B 2600/2519; F25B 2313/02743; F25B 2313/02541
See application file for complete search history.

(56) References Cited

U.S. PATENT DOCUMENTS

2012/0118533 A1 5/2012 Jang et al.
2013/0227985 A1 9/2013 Komano

FOREIGN PATENT DOCUMENTS

JP 2006-097978 A 4/2006
JP 2007-263444 A 10/2007
(Continued)

OTHER PUBLICATIONS

International Search Report ("ISR") dated Oct. 11, 2016 issued in corresponding international patent application No. PCT/JP2016/070219.
(Continued)

*Primary Examiner* — Ana M Vazquez
(74) *Attorney, Agent, or Firm* — Posz Law Group, PLC

(57) ABSTRACT

A heat exchanger group includes a first heat exchanger, a second heat exchanger, and a third heat exchanger. In a cooling operation, refrigerant discharged from the compressor is divided into two. One refrigerant is delivered to the second heat exchanger, and the other refrigerant is delivered to the third heat exchanger. The second heat exchanger performs heat exchange to turn the refrigerant into two-phase refrigerant. The third heat exchanger performs heat exchange to turn the refrigerant into two-phase refrigerant. The refrigerant that has flowed through the second heat exchanger and the refrigerant that has flowed through the third heat exchanger meet, and the resultant refrigerant is delivered to the first heat exchanger. The first heat exchanger
(Continued)

performs heat exchange, so that the two-phase refrigerant turns into liquid refrigerant and flows through the first heat exchanger.

10 Claims, 12 Drawing Sheets

(51) Int. Cl.

| | |
|---|---|
| ***F25B 6/00*** | (2006.01) |
| ***F25B 6/02*** | (2006.01) |
| ***F25B 6/04*** | (2006.01) |
| ***F25B 41/06*** | (2006.01) |

(52) U.S. Cl.
CPC ..... *F25B 6/04* (2013.01); *F25B 41/062* (2013.01); *F25B 2313/0292* (2013.01); *F25B 2313/02531* (2013.01); *F25B 2313/02533* (2013.01); *F25B 2313/02541* (2013.01); *F25B 2313/02743* (2013.01); *F25B 2341/0661* (2013.01); *F25B 2600/2513* (2013.01); *F25B 2600/2519* (2013.01)

(56) References Cited

FOREIGN PATENT DOCUMENTS

| | | | |
|---|---|---|---|
| JP | 2012-122670 | A | 6/2012 |
| JP | 2012-237543 | A | 6/2012 |
| JP | 2014-169830 | A | 9/2014 |
| JP | 2015-094531 | A | 5/2015 |
| JP | 2015-117936 | A | 6/2015 |

OTHER PUBLICATIONS

Office Action dated Jul. 18, 2019 issued in corresponding EP patent application No. 16908183.3.
Office Action dated Sep. 17, 2019 issued in corresponding JP patent application No. 2018-525904 (and English translation).
Extended European Search Report dated Nov. 13, 2019 issued in corresponding EP patent application No. 16908183.3.
Office Action dated Jan. 7, 2020 issued in corresponding JP patent application No. 2018-525904 (and English translation).
Office Action dated Aug. 25, 2020 issued in corresponding JP patent application No. 2019-203269 (and English translation).
Extended Search Report dated Dec. 2, 2020 issued in corresponding EP patent application No. 20190081.8.

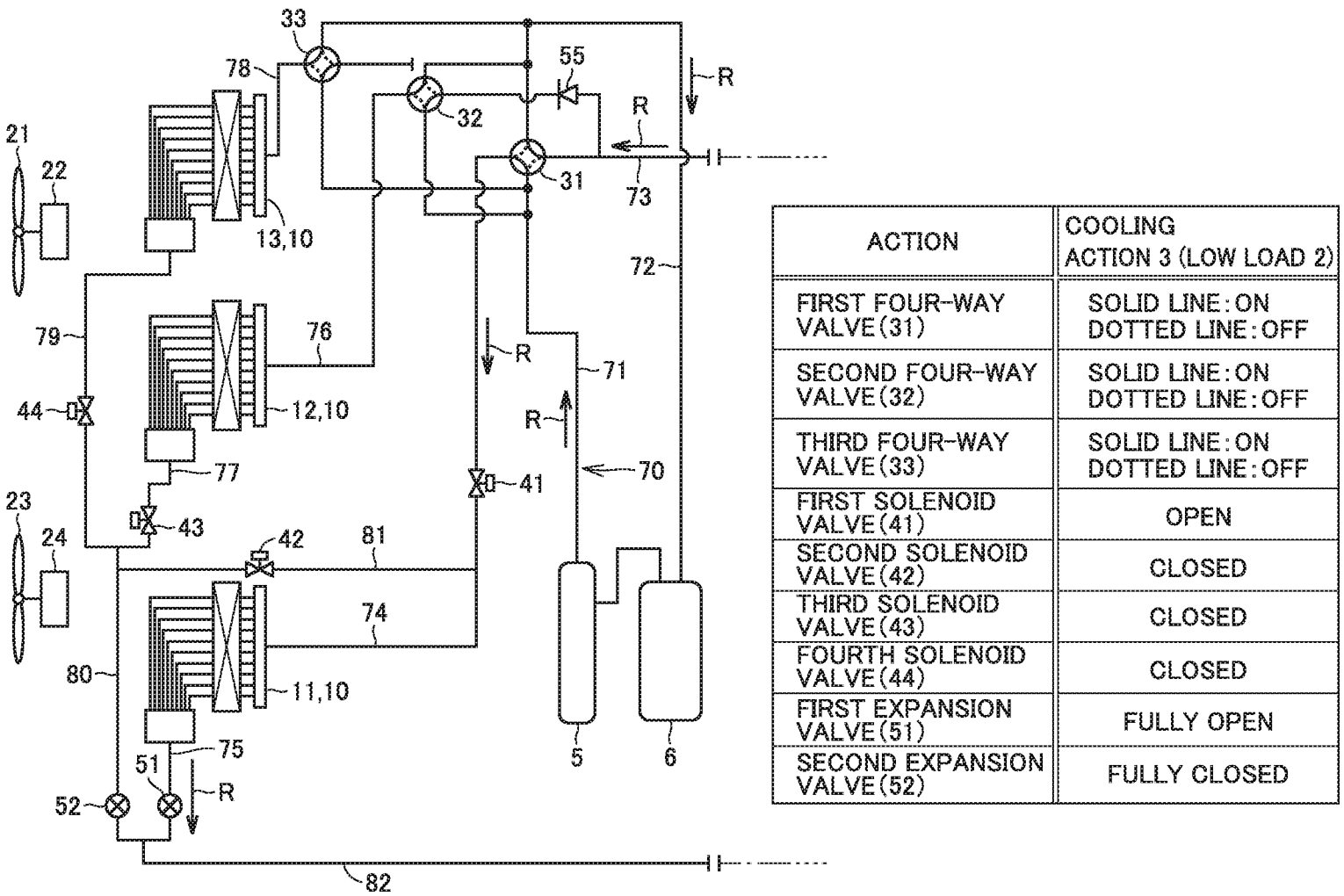

| ACTION | COOLING ACTION 3 (LOW LOAD 2) |
|---|---|
| FIRST FOUR-WAY VALVE (31) | SOLID LINE : ON DOTTED LINE : OFF |
| SECOND FOUR-WAY VALVE (32) | SOLID LINE : ON DOTTED LINE : OFF |
| THIRD FOUR-WAY VALVE (33) | SOLID LINE : ON DOTTED LINE : OFF |
| FIRST SOLENOID VALVE (41) | OPEN |
| SECOND SOLENOID VALVE (42) | CLOSED |
| THIRD SOLENOID VALVE (43) | CLOSED |
| FOURTH SOLENOID VALVE (44) | CLOSED |
| FIRST EXPANSION VALVE (51) | FULLY OPEN |
| SECOND EXPANSION VALVE (52) | FULLY CLOSED |

FIG.6

| ACTION | HEATING ACTION 2 |
|---|---|
| FIRST FOUR-WAY VALVE(31) | SOLID LINE : ON DOTTED LINE : OFF |
| SECOND FOUR-WAY VALVE(32) | SOLID LINE : ON DOTTED LINE : OFF |
| THIRD FOUR-WAY VALVE(33) | SOLID LINE : ON DOTTED LINE : OFF |
| FIRST SOLENOID VALVE(41) | OPEN |
| SECOND SOLENOID VALVE(42) | CLOSED |
| THIRD SOLENOID VALVE(43) | OPEN |
| FOURTH SOLENOID VALVE(44) | OPEN |
| FIRST EXPANSION VALVE(51) | DEGREE OF OPENING ADJUSTED |
| SECOND EXPANSION VALVE(52) | DEGREE OF OPENING ADJUSTED |

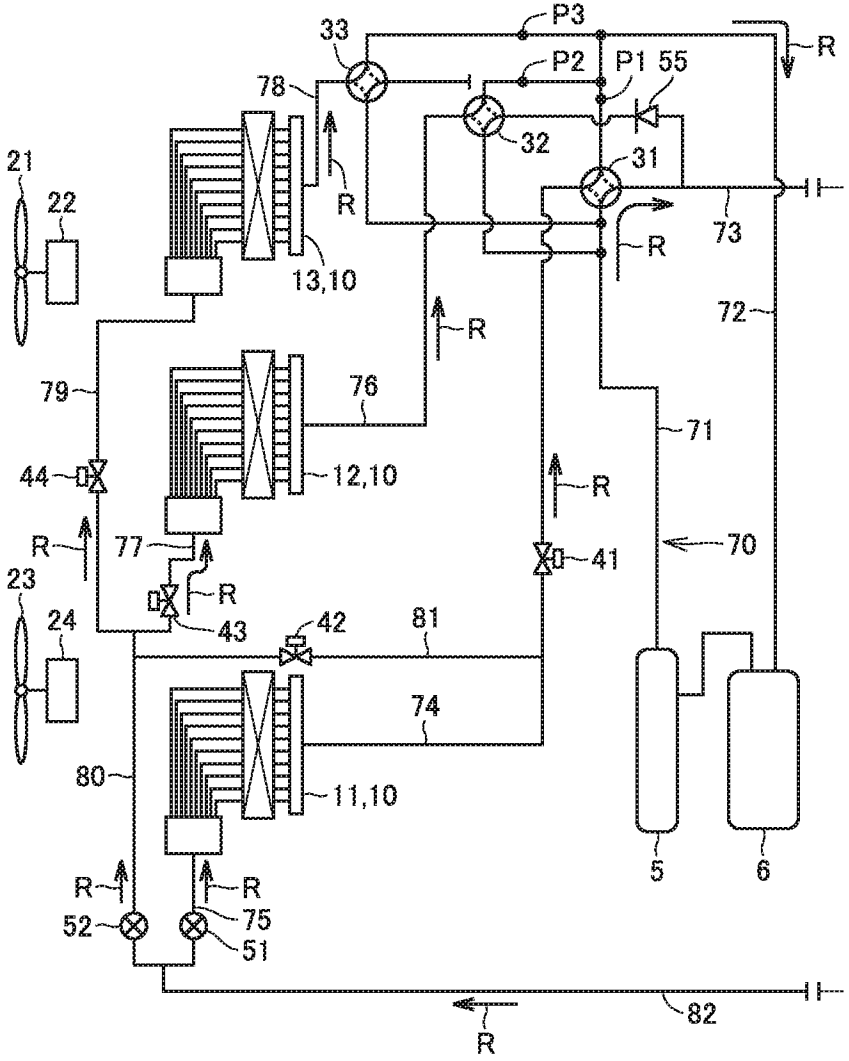

FIG.7

FIG.8

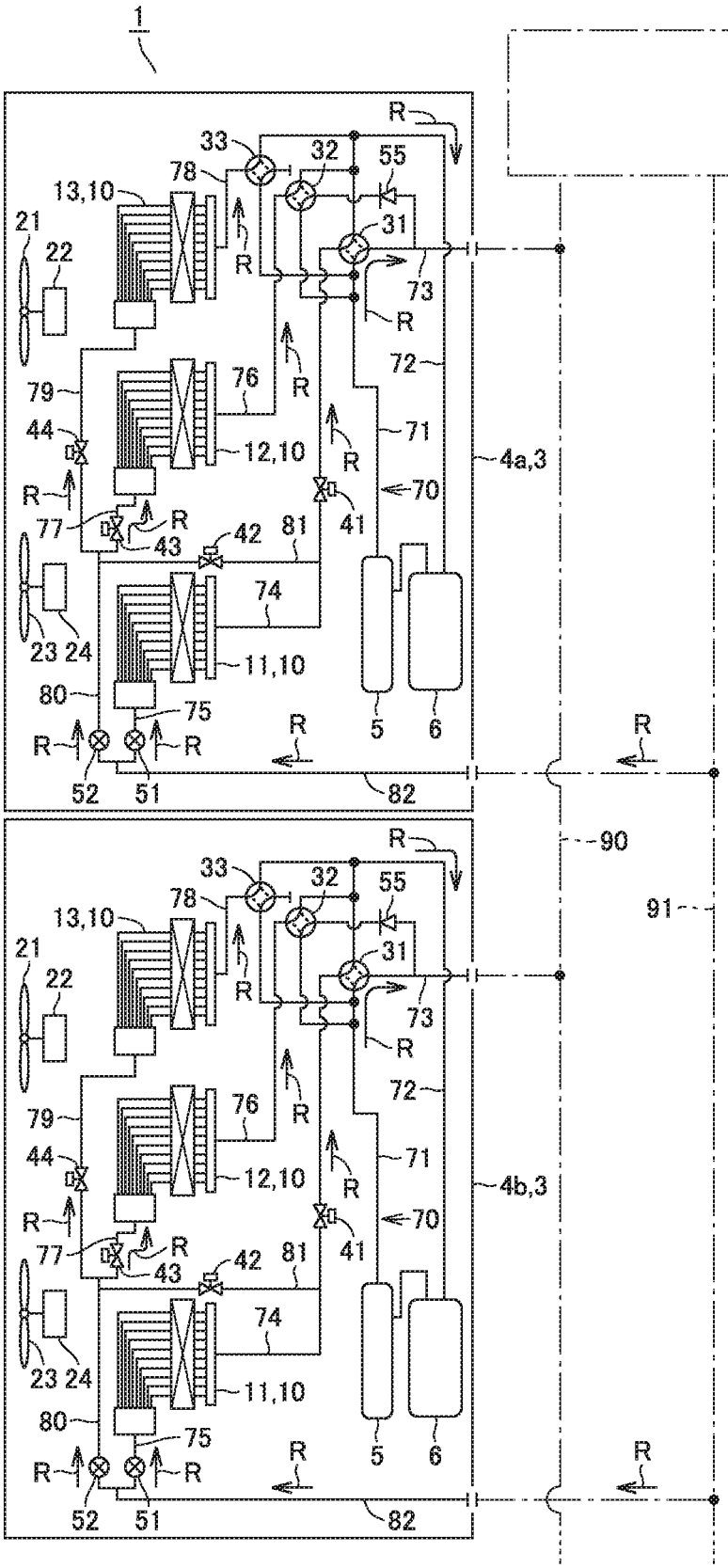

| ACTION | HEATING ACTION 3 |
|---|---|
| FIRST FOUR-WAY VALVE (31) | SOLID LINE: ON DOTTED LINE: OFF |
| SECOND FOUR-WAY VALVE (32) | SOLID LINE: ON DOTTED LINE: OFF |
| THIRD FOUR-WAY VALVE (33) | SOLID LINE: ON DOTTED LINE: OFF |
| FIRST SOLENOID VALVE (41) | OPEN |
| SECOND SOLENOID VALVE (42) | CLOSED |
| THIRD SOLENOID VALVE (43) | OPEN |
| FOURTH SOLENOID VALVE (44) | OPEN |
| FIRST EXPANSION VALVE (51) | DEGREE OF OPENING ADJUSTED |
| SECOND EXPANSION VALVE (52) | DEGREE OF OPENING ADJUSTED |

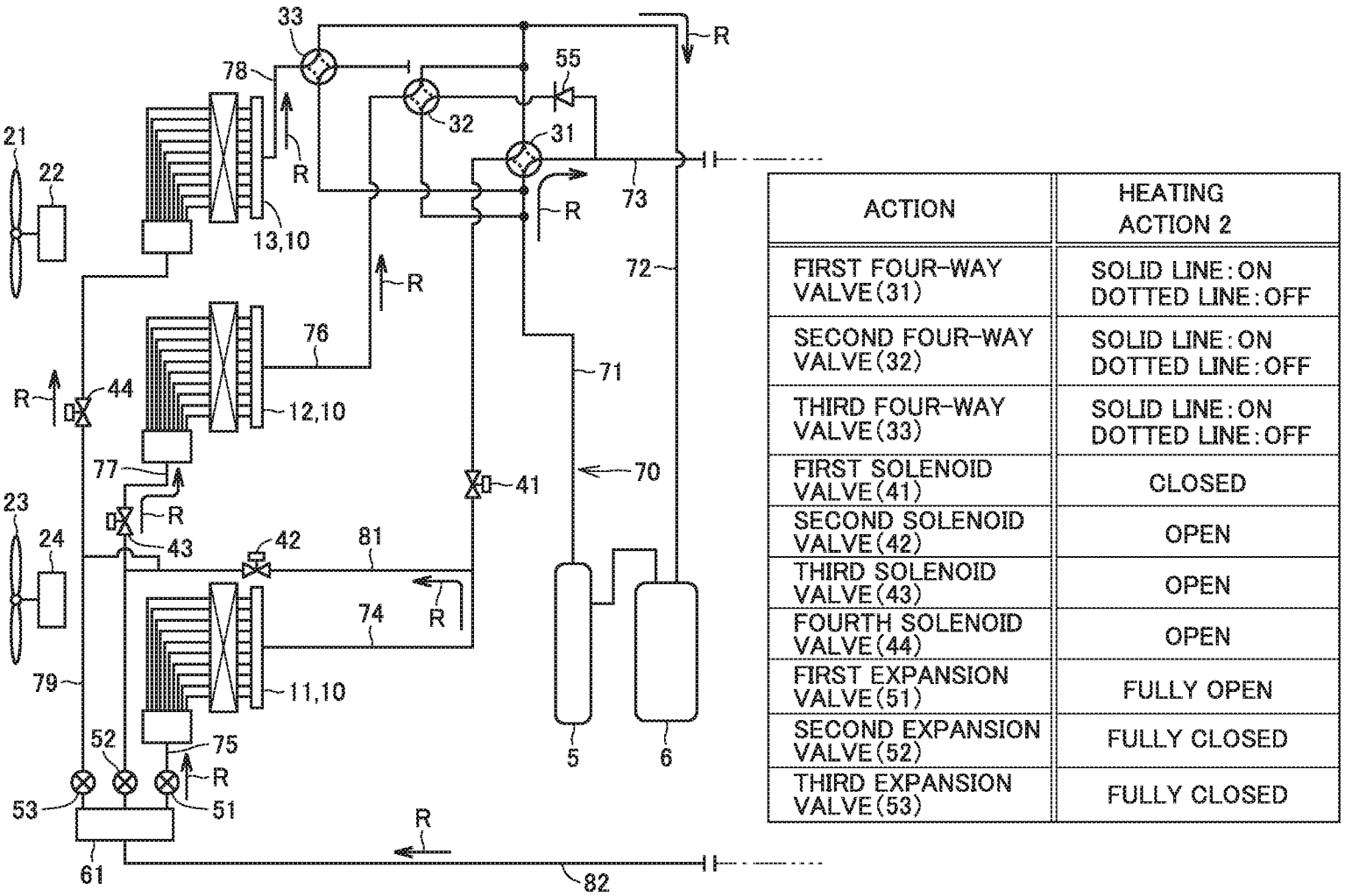

| ACTION | HEATING ACTION 2 |
|---|---|
| FIRST FOUR-WAY VALVE(31) | SOLID LINE: ON DOTTED LINE: OFF |
| SECOND FOUR-WAY VALVE(32) | SOLID LINE: ON DOTTED LINE: OFF |
| THIRD FOUR-WAY VALVE(33) | SOLID LINE: ON DOTTED LINE: OFF |
| FIRST SOLENOID VALVE(41) | CLOSED |
| SECOND SOLENOID VALVE(42) | OPEN |
| THIRD SOLENOID VALVE(43) | OPEN |
| FOURTH SOLENOID VALVE(44) | OPEN |
| FIRST EXPANSION VALVE(51) | FULLY OPEN |
| SECOND EXPANSION VALVE(52) | FULLY CLOSED |
| THIRD EXPANSION VALVE(53) | FULLY CLOSED |

FIG.12

REFRIGERANT CYCLE APPARATUS AND AIR CONDITIONING APPARATUS INCLUDING THE SAME

CROSS REFERENCE TO RELATED APPLICATION

This application is a U.S. national stage application of International Application PCT/JP2016/070219, filed on Jul. 8, 2016, the contents of which are incorporated herein by reference.

TECHNICAL FIELD

The present invention relates to a refrigerant cycle apparatus and an air conditioning apparatus including the same, and particularly, to a refrigerant cycle apparatus including an outdoor device including a plurality of heat exchangers and an air conditioning apparatus including the refrigerant cycle apparatus.

BACKGROUND

Air conditioning apparatuses are widely used to cool or heat, for example, a room. Such an air conditioning apparatus includes an indoor device housing an indoor heat exchanger and an outdoor device including an outdoor heat exchanger, a compressor, and the like.

In a cooling operation, high-temperature, high-pressure gas refrigerant discharged from the compressor flows into the outdoor heat exchanger of the outdoor device, is subjected to heat exchange with outdoor air, and is condensed into high-pressure liquid refrigerant. The high-pressure liquid refrigerant turns into two-phase refrigerant including low-pressure gas refrigerant and liquid refrigerant. The two-phase refrigerant flows into the indoor heat exchanger of the indoor device, and is subjected to heat exchange with indoor air. Consequently, the liquid refrigerant evaporates into low-pressure gas refrigerant. This heat exchange cools the room. The low-pressure gas refrigerant is delivered into the compressor to be compressed again.

In heating operation, the high-temperature, high-pressure gas refrigerant discharged from the compressor flows into the indoor heat exchanger of the indoor device, and is subjected to heat exchange with indoor air to be condensed into high-pressure liquid refrigerant. This heat exchange heats the room. The high-pressure liquid refrigerant turns into two-phase refrigerant including low-pressure gas refrigerant and liquid refrigerant. The two-phase refrigerant flows into the outdoor heat exchanger of the outdoor device is subjected to heat exchange with outdoor air. Consequently, the liquid refrigerant evaporates into low-pressure gas refrigerant. The low-pressure gas refrigerant is delivered into the compressor to be compressed again.

An air conditioning apparatus includes an outdoor heat exchanger including a plurality of heat exchangers as an outdoor heat exchanger in order to increase its heat exchange performance according to the circumstances. For example, the air conditioning apparatus described in PTL 1 includes two heat exchangers, namely, a first heat exchanger and a second heat exchanger, disposed in an outdoor device.

The first heat exchanger has a plurality of first unit flow paths. The second heat exchanger has a plurality of second unit flow paths. The first unit flow paths and the second unit flow paths are set to the same number (number A). The length of the first unit flow path and the length of the second unit flow path are set to the same length (length L).

In heating operation, refrigerant flows through the first heat exchanger or second heat exchanger connected in parallel. In this operation, the number of flow paths through which the refrigerant flows is twice the number A (2×A), and the length of the flow path through which the refrigerant flows is length L. In heating operation, an increase in the number of flow paths reduces the flow velocity of the refrigerant, minimizing a pressure loss.

On the other hand, in cooling operation, the refrigerant flows through the first heat exchanger and the second heat exchanger connected in series. In this operation, the number of flow paths through which the refrigerant flows is number A, and the length of the flow path through which the refrigerant flows is a length (2×L) which is twice the length L. In cooling operation, reducing the number of flow paths leads to a higher flow velocity of the refrigerant, thus facilitating heat transfer more than in heating operation.

PATENT LITERATURE

PTL 1: Japanese Patent Laying-Open No. 2015-117936

A conventional air conditioning apparatus suffers from the following. When an air conditioning apparatus is caused to perform the cooling operation, the outdoor heat exchanger functions as a condenser. During this operation, high-temperature, high-pressure gas refrigerant discharged from the compressor first flows into the first heat exchanger. The first heat exchanger performs heat exchange between the outdoor air and the gas refrigerant, and the gas refrigerant starts condensation to gradually liquefy into two-phase refrigerant including liquid refrigerant and gas refrigerant.

The two-phase refrigerant flows from the first heat exchanger into the second heat exchanger. The second heat exchanger performs heat exchange between the outdoor air and the two-phase refrigerant, and the remaining gas refrigerant liquefies further, finally turning into single-phase liquid refrigerant. In other words, in the second heat exchanger, the single-phase liquid refrigerant (subcool) flows from partway along the second unit flow path.

As described above, when the outdoor heat exchanger is caused to function as a condenser, it is required to increase the flow velocity of liquid refrigerant for higher heat transfer performance. However, the number of first unit flow paths of the first heat exchanger and the number of second unit flow paths of the second heat exchanger are set to the same number (number A). Thus, the flow velocity of the liquid refrigerant that has turned into single-phase liquid refrigerant from partway along the second unit flow path of the second heat exchanger can be increased less easily, making it difficult to increase the heat transfer performance in a portion of the second unit flow path at which refrigerant flows through the second unit flow path as liquid refrigerant.

SUMMARY

The present invention has been made to solve the above problem, and has an object to provide a refrigerant cycle apparatus capable of increasing heat transfer performance and another object to provide an air conditioning apparatus including the refrigerant cycle apparatus.

A refrigerant cycle apparatus according to the present invention includes an outdoor device including a heat exchanger group including a plurality of heat exchangers, and a refrigerant circuit in which the heat exchanger group is connected by a pipe. In a first operation of causing the heat exchanger group to operate as a condenser, refrigerant flowing inside the pipe flows through a first number of heat exchangers connected in parallel and then flows through a second number of heat exchangers. In a second operation of causing the heat exchanger group to operate as an evaporator, refrigerant flowing inside the pipe flows through a third number of heat exchangers connected in parallel. The third number is a sum of the first number and the second number. The second number is smaller than the first number.

An air conditioning apparatus according to the present invention is an air conditioning apparatus including the refrigerant cycle apparatus.

In the refrigerant cycle apparatus according to the present invention, in the first operation of causing the heat exchanger group to operate as a condenser, refrigerant flowing inside the pipe flows through the first number of heat exchangers connected in parallel and then flows through the second number of heat exchangers, where the second number is smaller than the first number. This increases a flow velocity of refrigerant that turns into liquid refrigerant and flows through the third heat exchanger, thus improving heat transfer performance when the heat exchanger group is caused to operate as a condenser.

The refrigerant cycle apparatus according to the present invention includes the outdoor device, thus improving heat transfer performance when the heat exchanger group is caused to operate as a condenser.

BRIEF DESCRIPTION OF DRAWINGS

FIG. 6 shows a flow of refrigerant for illustrating another second example of the cooling operation in Embodiment 1.

FIG. 7 shows a flow of refrigerant for illustrating a second example of the heating operation in Embodiment 1.

FIG. 8 shows a flow of refrigerant for illustrating a third example of the heating operation in Embodiment 1.

FIG. 12 shows a flow of refrigerant for illustrating another fourth example of the heating operation in Embodiment 2.

DETAILED DESCRIPTION

Embodiment 1

[Configuration]

Figure 1:
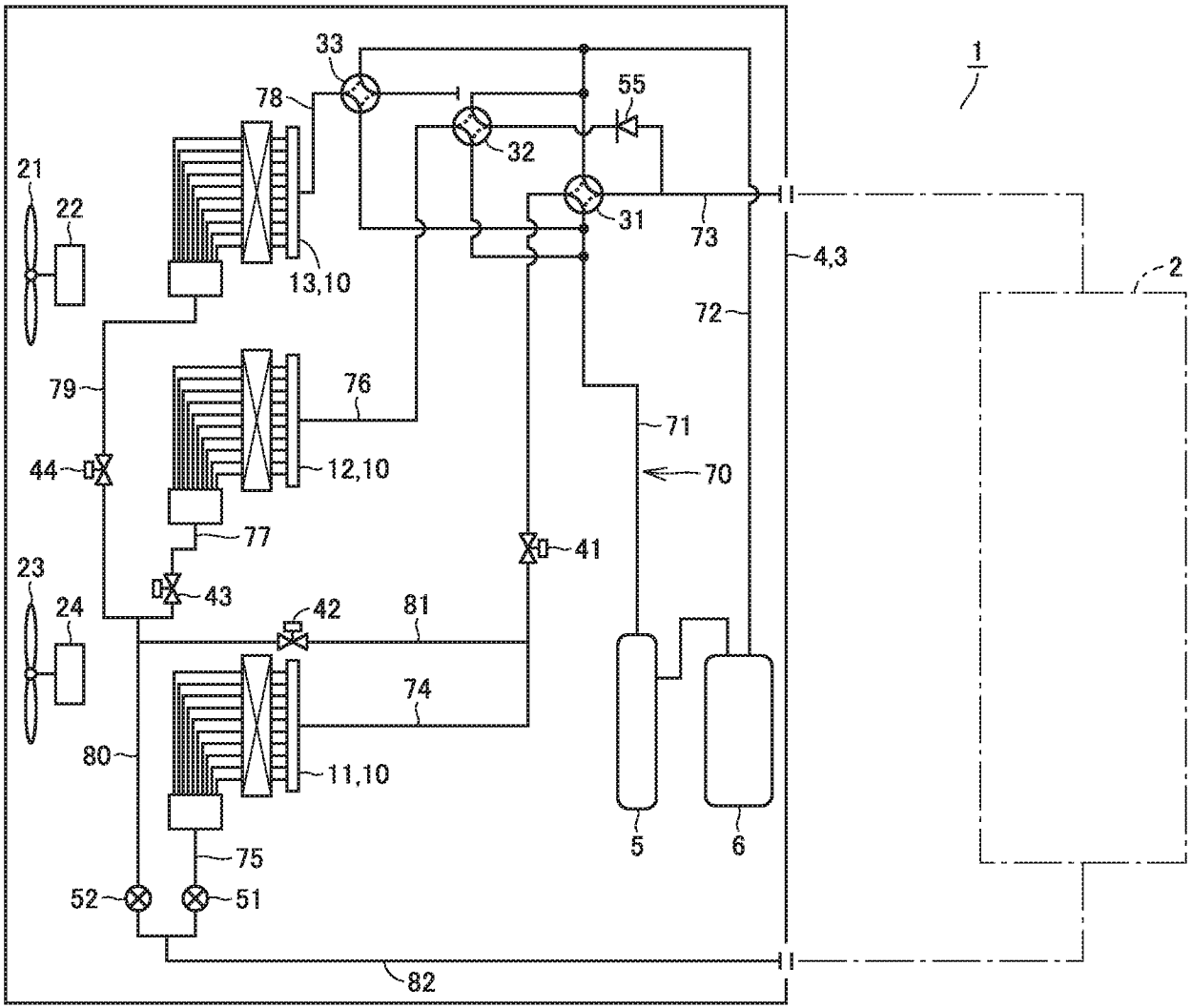
FIG. 1 shows a configuration of an air conditioning apparatus including an outdoor device according to Embodiment 1, which includes a refrigerant circuit.

An overall configuration of an air conditioning apparatus serving as a refrigerant cycle apparatus will be described first. As shown in FIG. 1, an air conditioning apparatus 1 includes an indoor device 2 and an outdoor device 3 including an outdoor unit 4. Indoor device 2 houses an indoor heat exchanger (not shown). For the sake of convenience of description, one outdoor unit 4 is described representatively as an example.

Air conditioning apparatus 1 includes a compressor 5, a first four-way valve 31, a second four-way valve 32, a third four-way valve 33, a first heat exchanger 11, a second heat exchanger 12, a third heat exchanger 13, a first expansion valve 51, a second expansion valve 52, and an indoor heat exchanger (not shown). First heat exchanger 11, second heat exchanger 12, and third heat exchanger 13 (heat exchanger group 10) serve as outdoor heat exchangers. Compressor 5, first four-way valve 31, second four-way valve 32 and third four-way valve 33, heat exchanger group 10, first expansion valve 51 and second expansion valve 52, and indoor heat exchanger are connected to each other in order by a refrigerant pipe 70, thus constituting a refrigerant circuit. Description will be given, where the path for refrigerant flowing between the respective components connected to refrigerant pipe 70 is referred to as a flow path in refrigerant pipe 70.

Specifically, between compressor 5 and heat exchanger group 10, first four-way valve 31, first heat exchanger 11, and first expansion valve 51 are connected in series, second four-way valve 32 and second heat exchanger 12 are connected in series, and third four-way valve 33 and third heat exchanger 13 are connected in series. First four-way valve 31, first heat exchanger 11, and first expansion valve 51 connected in series, second four-way valve 32 and second heat exchanger 12 connected in series, and third four-way valve 33 and third heat exchanger 13 connected in series are connected in parallel. First expansion valve 51 and second expansion valve 52 are connected in parallel.

Refrigerant pipe 70 (flow path 77) running from second heat exchanger 12 toward second expansion valve 52 and refrigerant pipe 70 (flow path 79) running from third heat exchanger 13 toward second expansion valve 52 meet and are connected to refrigerant pipe 70 (flow path 80) connected to second expansion valve 52. Refrigerant pipe 70 (flow path 81) serving as a bypass pipe is connected between refrigerant pipe 70 (flow path 80) connecting second heat exchanger 12 and third heat exchanger 13 to second expansion valve 52 and refrigerant pipe 70 (flow path 74) connecting first four-way valve 31 and first heat exchanger 11 to each other.

Further, a third solenoid valve 43 is provided in the refrigerant pipe (flow path 77) running from second heat exchanger 12 toward second expansion valve 52. A fourth solenoid valve 44 is provided in refrigerant pipe 70 (flow path 79) running from third heat exchanger 13 toward second expansion valve 52. A second solenoid valve 42 is provided in refrigerant pipe 70 (flow path 81) serving as a bypass pipe. A first solenoid valve 41 is provided in refrigerant pipe 70 (flow path 74) connecting first four-way valve 31 and first heat exchanger 11 to each other.

First solenoid valve 41, second solenoid valve 42, third solenoid valve 43, and fourth solenoid valve 44 are valves for controlling a flow of refrigerant flowing through the flow paths in refrigerant pipe 70. Opening first solenoid valve 41, second solenoid valve 42, third solenoid valve 43, and fourth solenoid valve 44 allows refrigerant to flow through predetermined flow paths in refrigerant pipe 70. Closing first solenoid valve 41, second solenoid valve 42, third solenoid valve 43, and fourth solenoid valve 44 stops a flow of refrigerant in the predetermined flow paths. In air conditioning apparatus 1, refrigerant pipe 70 (flow path 81) serving as the bypass pipe, first solenoid valve 41, and second solenoid valve 42 allow first heat exchanger 11 connected in parallel with second heat exchanger 12 and third heat exchanger 13 to be connected in series to second heat exchanger 12 and third heat exchanger 13.

A detailed description will be given below. Outdoor device 3 houses first heat exchanger 11, second heat exchanger 12, and third heat exchanger 13 as heat exchanger group 10. Used as first heat exchanger 11, second heat exchanger 12, and third heat exchanger 13 are equal heat exchangers having the same physical structure such as the size, the number of paths (PN) of refrigerant paths, and the arrangement of fins.

A first fan 21, a first motor 22, a second fan 23, and a second motor 24 for blowing outdoor air are arranged in heat exchanger group 10. Outdoor device 3 also houses compressor 5 that compresses refrigerant and an accumulator 6 that stores liquid refrigerant.

The discharge side of compressor 5 is connected with flow path 71. The suction side of compressor 5 is connected with flow path 72 via accumulator 6. Outdoor device 3 and indoor device 2 are connected to each other via flow path 73 and flow path 82.

First heat exchanger 11 is connected with flow path 74 and flow path 75. Second heat exchanger 12 is connected with flow path 76 and flow path 77. Third heat exchanger 13 is connected with flow path 78 and flow path 79.

When heat exchanger group 10 is operated (cooling operation) as a condenser, in first heat exchanger 11, refrigerant flows from flow path 74 via first heat exchanger 11 through flow path 75. In second heat exchanger 12, refrigerant flows from flow path 76 via second heat exchanger 12 through flow path 77. In third heat exchanger 13, refrigerant flows from flow path 78 via third heat exchanger 13 through flow path 79.

On the other hand, when heat exchanger group 10 is operated (heating operation) as an evaporator, refrigerant flows from flow path 75 via first heat exchanger 11 through flow path 74 in first heat exchanger 11. In second heat exchanger 12, refrigerant flows from flow path 76 via second heat exchanger 12 through flow path 77. In third heat exchanger 13, refrigerant flows from flow path 78 via third heat exchanger 13 through flow path 79.

First four-way valve 31, second four-way valve 32, and third four-way valve 33 are provided for switching a refrigerant flow between in the first operation (cooling operation) of causing heat exchanger group 10 to operate as a condenser and in the second operation (heating operation) of causing heat exchanger group 10 to operate as an evaporator.

In first four-way valve 31, in the cooling operation, flow path 71 and flow path 74 are connected to each other, and flow path 72 and flow path 73 are connected to each other; in the heating operation, flow path 71 and flow path 73 are connected to each other, and flow path 72 and flow path 74 are connected to each other.

In second four-way valve 32, in the cooling operation, flow path 71 and flow path 76 are connected to each other, and flow path 72 and flow path 73 are connected to each other via a check valve 55; in the heating operation, flow path 76 and flow path 72 are connected to each other. In third four-way valve 33, in the cooling operation, flow path 71 and flow path 78 are connected to each other; in the heating operation, flow path 78 and flow path 72 are connected to each other.

First solenoid valve 41, second solenoid valve 42, third solenoid valve 43, and fourth solenoid valve 44 for switching a refrigerant flow are provided to support various operations. Further, first expansion valve 51 and second expansion valve 52 for adjusting the flow rate of refrigerant are provided.

First solenoid valve 41 is provided in flow path 74. Second solenoid valve 42 is provided in flow path 81. Third solenoid valve 43 is provided in flow path 77. Fourth solenoid valve 44 is provided in flow path 79. First expansion valve 51 is a linear electronic expansion valve provided in flow path 75. Second expansion valve 52 is a linear electronic expansion valve provided in flow path 80. Flow path 80 is connected to flow path 77 and flow path 79 and to flow path 82. Flow path 81 is connected to flow path 74 and flow path 80. Air conditioning apparatus 1 according to Embodiment 1 is configured as described above.

[Cooling Operation: Action 1]

Figure 2:
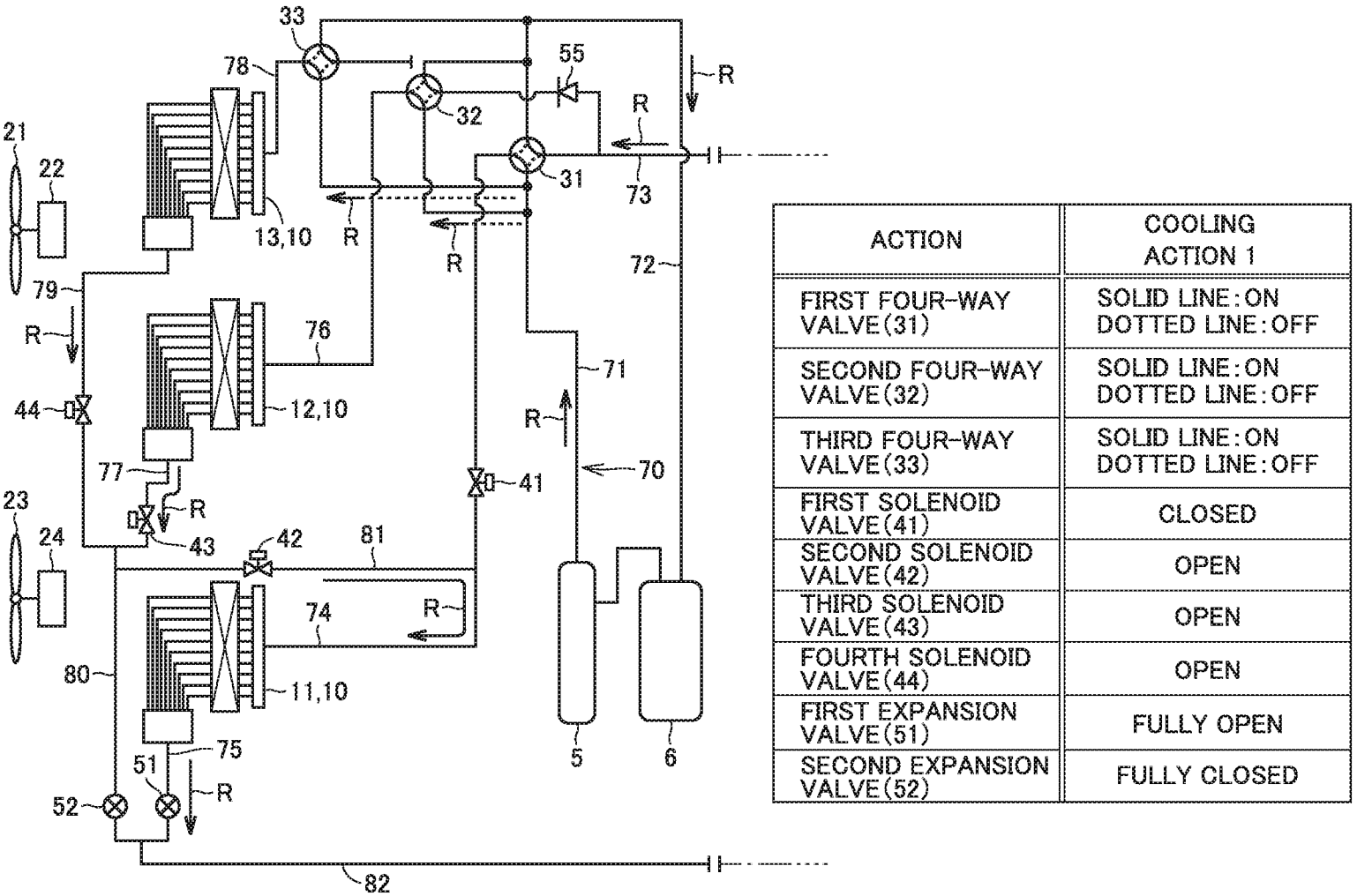
FIG. 2 shows a flow of refrigerant for illustrating a first example of a cooling operation in Embodiment 1.

A first action of the first operation (cooling operation) of causing heat exchanger group 10 to operate as a condenser will now be described as the action of air conditioning apparatus 1 described above. As shown in FIG. 2, in this case, first solenoid valve 41 is "closed". Second solenoid valve 42, third solenoid valve 43, and fourth solenoid valve 44 are "open". First expansion valve 51 is "fully open". Second expansion valve 52 is "fully closed". In each of first four-way valve 31, second four-way valve 32, and third four-way valve 33, a solid line indicates ON (open), and a dotted line indicates OFF (closed). The same applies to the following.

High-temperature, high-pressure gaseous refrigerant R discharged from compressor 5 flows through flow path 71 and is divided to flow path 76 and flow path 78. Refrigerant R flows through second four-way valve 32 and flow path 76 and is then delivered to second heat exchanger 12. Refrigerant R flows through third four-way valve 33 and flow path 78 and is then delivered to third heat exchanger 13.

Second heat exchanger 12 performs heat exchange between refrigerant R and outdoor air, so that gaseous refrigerant R starts condensation to gradually liquefy into two-phase refrigerant including liquid refrigerant and gas refrigerant. Third heat exchanger 13 performs heat exchange between refrigerant R and outdoor air, so that gaseous refrigerant R starts condensation to gradually liquefy into two-phase refrigerant including liquid refrigerant and gas refrigerant.

Two-phase refrigerant R that has flowed through second heat exchanger 12 and two-phase refrigerant R that has flowed through third heat exchanger 13 flow through flow path 80 and meet. The resultant refrigerant R flows through flow path 81 and flow path 74 and is then delivered to first heat exchanger 11. First heat exchanger 11 performs heat exchange between refrigerant R and outdoor air, so that the remaining gas refrigerant liquefies further. This eventually changes refrigerant R into single-phase liquid refrigerant (subcool) to flow through first heat exchanger 11.

Refrigerant R that has flowed through first heat exchanger 11 flows through flow path 75 (first expansion valve 51) and flow path 82 and is then delivered to indoor device 2 (see FIG. 1). In indoor device 2, liquid refrigerant R is subjected to heat exchange with the indoor air and evaporates into low-pressure gas refrigerant. This heat exchange cools the room. Refrigerant R that has turned into low-pressure gas refrigerant flows through flow path 73, first four-way valve 31 or second four-way valve 32, and flow path 72 and is then delivered into compressor 5 to be compressed again. This action is repeated thereafter.

In air conditioning apparatus 1 described above, in the cooling operation, one refrigerant discharged from compressor 5 and the other refrigerant discharged from compressor 5 meet after flowing respectively through second heat exchanger 12 and third heat exchanger 13 in parallel. The resultant refrigerant flows through first heat exchanger 11, improving heat transfer performance. This will be described in comparison with an air conditioning apparatus according to a comparative example.

Figure 3:
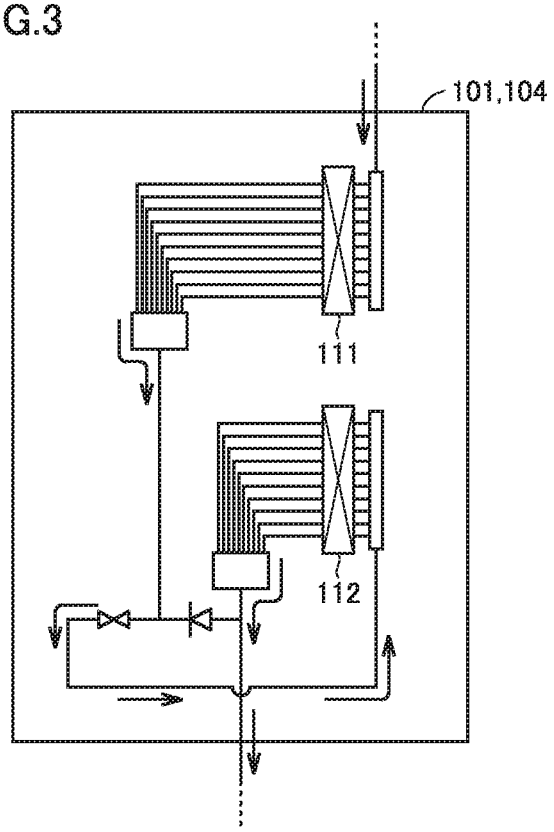
FIG. 3 shows an outdoor device of an air conditioning apparatus according to a comparative example and a flow of refrigerant in the outdoor device in the cooling operation.

As shown in FIG. 3, in an air conditioning apparatus 101 according to the comparative example, in the cooling operation, the high-temperature, high-pressure gas refrigerant discharged from a compressor (not shown) first flows into a first heat exchanger 111 disposed in an outdoor unit 104. In first heat exchanger 111, gas refrigerant is subjected to heat exchange with outdoor air to be condensed, turning into two-phase refrigerant including liquid refrigerant and gas refrigerant.

The two-phase refrigerant flows from first heat exchanger 111 into a second heat exchanger 112 as indicated by the arrows. In second heat exchanger 112, the two-phase refrigerant is subjected to heat exchange with outdoor air, so that the remaining gas refrigerant liquefies further into single-phase liquid refrigerant (subcool) from partway along second heat exchanger 112.

Herein, the number of first unit flow paths of first heat exchanger 111 and the number of second unit flow paths of second heat exchanger 112 are set to the same number. Thus, the flow velocity of the liquid refrigerant that has turned into single-phase liquid refrigerant from partway along second heat exchanger 112 can be increased less easily. As a result, it is difficult to improve heat transfer performance at a portion of the second unit flow path at which refrigerant flows through second heat exchanger 112 as liquid refrigerant.

When the number of first unit flow paths and the number of second unit flow paths are equal to each other, a pressure loss of the refrigerant flowing in the two-phase state increases. Reducing such a pressure loss increases the number of flow paths, thus deteriorating the heat transfer performance of the portion of the second unit flow path at which refrigerant flows as the liquid refrigerant (subcool). In other words, a pressure loss of the refrigerant flowing in the two-phase state and the heat transfer performance of the portion of the second unit flow path at which refrigerant flows as liquid refrigerant (subcool) have a trade-off relationship.

Unlike air conditioning apparatus 101 according to the comparative example, air conditioning apparatus 1 described above includes three equal heat exchangers as first heat exchanger 11, second heat exchanger 12, and third heat exchanger 13, and the path number of refrigerant paths through which refrigerant flows is the same path number (PN).

In the cooling operation, one refrigerant discharged from compressor 5 and the other refrigerant discharged from compressor 5 meet after flowing respectively through second heat exchanger 12 and third heat exchanger 13 in parallel, and the resultant refrigerant flows through first heat exchanger 11. At this time, the path number (PN) of refrigerant paths over which refrigerant flows through first heat exchanger 11 is a half of the path number (2×PN) of refrigerant paths over which refrigerant flows through second heat exchanger 12 and third heat exchanger 13 in parallel.

Thus, the flow velocity at which refrigerant finally turns into single-phase liquid refrigerant (subcool) and flows through first heat exchanger 11 increases. An increase in the flow velocity of the liquid refrigerant improves heat transfer performance when heat exchanger group 10 is operated as a condenser.

[Heating Operation: Action 1]

A first action of the second operation (heating operation) of causing heat exchanger group 10 to operate as an evaporator will now be described as the action of air conditioning apparatus 1 described above.

Figure 4:
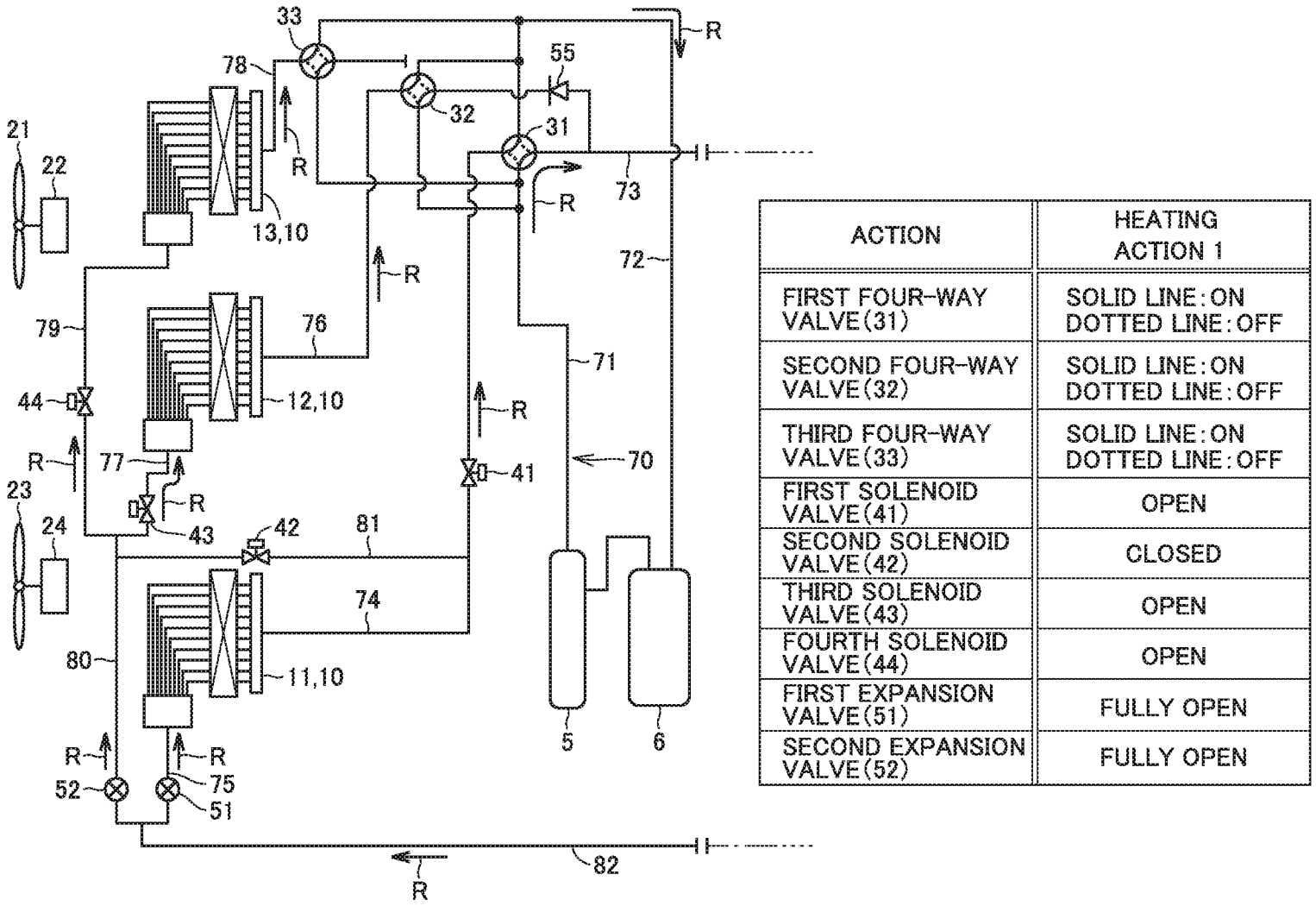
FIG. 4 shows a flow of refrigerant for illustrating a first example of a heating operation in Embodiment 1.

As shown in FIG. 4, in this case, first solenoid valve 41, third solenoid valve 43, and fourth solenoid valve 44 are "open". Second solenoid valve 42 is "closed". First expansion valve 51 and second expansion valve 52 are "fully open".

High-temperature, high-pressure gaseous refrigerant R discharged from compressor 5 flows through flow path 71 and first four-way valve 31 and is then delivered to indoor device 2 (see FIG. 1). In indoor device 2, gaseous refrigerant R is subjected to heat exchange with indoor air and is condensed into high-pressure liquid refrigerant. This heat exchange heats the room. Refrigerant R that has turned into liquid refrigerant turns into two-phase refrigerant including low-pressure gas refrigerant and liquid refrigerant, flows through flow path 82, and is then delivered to outdoor device 3.

Refrigerant R delivered to outdoor device 3 is divided to flow path 80 and flow path 75. Refrigerant R that has flowed through flow path 75 (first expansion valve 51) is delivered to first heat exchanger 11. Refrigerant R that has flowed through flow path 80 (second expansion valve 52) is further divided to flow path 77 and flow path 79. Refrigerant R that has flowed through flow path 77 (third solenoid valve 43) is delivered to second heat exchanger 12. Refrigerant R that has flowed through flow path 79 (fourth solenoid valve 44) is delivered to third heat exchanger 13.

First heat exchanger 11 performs heat exchange between refrigerant R and outdoor air, so that two-phase refrigerant R evaporates into gas refrigerant. Second heat exchanger 12 performs heat exchange between refrigerant R and outdoor air, so that two-phase refrigerant R evaporates into gas refrigerant. Third heat exchanger 13 performs heat exchange between refrigerant R and outdoor air, so that two-phase refrigerant R evaporates into gas refrigerant.

Refrigerant R that has flowed through first heat exchanger 11 and turned into gas refrigerant flows through flow path 74 (first solenoid valve 41) and first four-way valve 31. Refrigerant R that has flowed through second heat exchanger 12 and turned into gas refrigerant flows through flow path 76 and second four-way valve 32. Refrigerant R that has flowed through third heat exchanger 13 and turned into gas refrigerant flows through flow path 78 and third four-way valve 33.

Refrigerant R that has flowed through first four-way valve 31, refrigerant R that has flowed through second four-way valve 32, and refrigerant R that has flowed through third four-way valve 33 meet, and the resultant refrigerant R flows through flow path 72. Refrigerant R flowing through flow path 72 is delivered into compressor 5 via accumulator 6 to be compressed again. Hereinafter, this action is repeated.

In air conditioning apparatus 1 described above, in the heating operation, refrigerant R delivered from indoor device 2 flows through first heat exchanger 11, second heat exchanger 12, and third heat exchanger 13 in parallel in outdoor device 3. At this time, the path number of refrigerant paths is a path number (3×PN) three times the path number PN per heat exchanger. In the heating operation, thus, the number of refrigerant paths is greater than in the cooling operation. Consequently, in the heating operation of causing heat exchanger group 10 to operate as an evaporator, a pressure loss of the refrigerant decreases to improve the performance of heat exchanger group 10 serving as an evaporator, thus improving heating performance.

The effects achieved by the use of three four-way valves, namely, first four-way valve 31, second four-way valve 32, and third four-way valve 33 in outdoor device 3 will now be described.

As described above, in the first example of the cooling operation, high-temperature, high-pressure refrigerant R discharged from compressor 5 and divided flows trough second four-way valve 32 and third four-way valve 33. Low-pressure refrigerant R delivered from indoor device 2 flows through first four-way valve 31 and second four-way valve 32.

As a result, a pressure loss of high-temperature, high-pressure refrigerant R can be reduced more than when high-temperature, high-pressure refrigerant R discharged from compressor 5 flows through one four-way valve. A pressure loss of low-pressure refrigerant R can be reduced more than when low-pressure refrigerant R delivered from indoor device 2 flows through one four-way valve.

Contrastingly, in the first example of the heating operation, high-temperature, high-pressure refrigerant R discharged from compressor 5 flows through first four-way valve 31. Low-pressure refrigerant R that has flowed through first heat exchanger 11 flows through first four-way valve 31. Low-pressure refrigerant R that has flowed through second heat exchanger 12 flows through second four-way valve 32. Low-pressure refrigerant R that has flowed through third heat exchanger 13 flows through third four-way valve 33. As a result, a pressure loss of low-pressure refrigerant R can be reduced more than when refrigerant R flows through one four-way valve.

High-temperature, high-pressure refrigerant R flows through first four-way valve 31 and does not flow through second four-way valve 32 and third four-way valve 33. Thus, low-pressure refrigerant R flowing through second four-way valve 32 is not subjected to heat exchange with high-temperature, high-pressure refrigerant R inside second four-way valve 32. Also, low-pressure refrigerant R flowing through third four-way valve 33 is not subjected to heat exchange with high-temperature, high-pressure refrigerant R within third four-way valve 33. As a result, a heat exchange loss can be reduced within second four-way valve 32 and third four-way valve 33.

[Cooling Operation: Action 2]

A second action performed when a load in the first operation (cooling operation) of causing heat exchanger group 10 of air conditioning apparatus 1 described above to operate as a condenser will now be described.

For example, a cooling load may be generated in, for example, a computer server room throughout the year. Also, outdoor air temperature may be relatively low also in the summer. Further, even when outdoor air temperature is not low, the load of an indoor device may be low. In such a situation, the load in the cooling operation is low. When the load in the cooling operation is low, the performance of heat exchanger group 10 or the like is lowered in order to maintain the compression ratio of the compressor.

One way to reduce the performance of heat exchanger group 10 or the like is reducing the volume of air generated by first fan 21 and second fan 23. There is, however, a limitation on the way to reduce the volume of air. Adopted in such a case is a way in which some heat exchangers of heat exchanger group 10 are not used.

Figure 5:
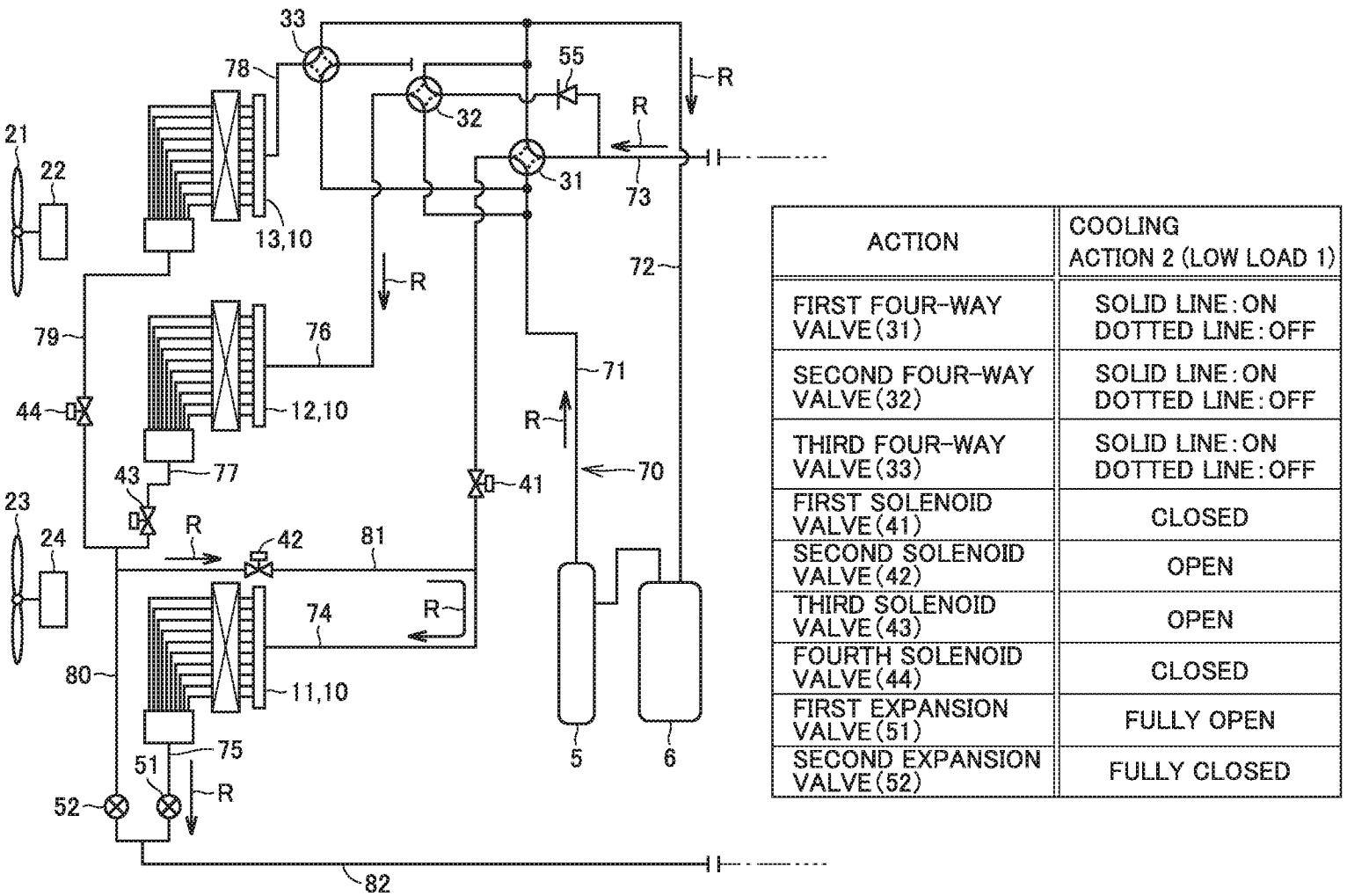
FIG. 5 shows a flow of refrigerant for illustrating a second example of the cooling operation in Embodiment 1.

As shown in FIG. 5, in this case, first solenoid valve 41 and fourth solenoid valve 44 are "closed". Second solenoid valve 42 and third solenoid valve 43 are "open". First expansion valve 51 is "fully open". Second expansion valve 52 is "fully closed".

High-temperature, high-pressure gaseous refrigerant R discharged from compressor 5 flows through flow path 71, second four-way valve 32, and flow path 76 and is then delivered to second heat exchanger 12. Second heat exchanger 12 performs heat exchange between refrigerant R and outdoor air, so that refrigerant R condenses. Refrigerant R that has flowed through second heat exchanger 12 flows through flow path 77 (third solenoid valve 43), flow path 81 (second solenoid valve 42), and flow path 74 and is then delivered to first heat exchanger 11. In first heat exchanger 11, gaseous refrigerant R is further subjected to heat exchange with outdoor air to be condensed into liquid refrigerant.

Refrigerant R that has flowed through the first heat exchanger flows through flow path 75 and flow path 82 and is then delivered to indoor device 2 (see FIG. 1). In indoor device 2, gaseous refrigerant R is subjected to heat exchange with indoor air to evaporate into low-pressure gas refrigerant. This heat exchange cools the room. Refrigerant R that has turned into low-pressure gas refrigerant flows through flow path 73, first four-way valve 31 or second four-way valve 32, and flow path 72 and is then delivered into compressor 5 to be compressed again. Hereinafter, this action is repeated.

In air conditioning apparatus 1 described above, when the load in the cooling operation is low, of heat exchanger group 10, second heat exchanger 12 and first heat exchanger 11 are used and third heat exchanger 13 is not used. As a result, the cooling operation according to a load can be performed to maintain the compression ratio of compressor 5, allowing compressor 5 to discharge desired high-temperature, high-pressure refrigerant R.

In third four-way valve 33, flow path 71 and flow path 78 are closed not to be connected to each other. This can prevent high-pressure refrigerant R from flowing into third heat exchanger 13. Consequently, refrigerant R can be prevented from remaining in third heat exchanger 13, thus preventing a lack of a required amount of refrigerant as air conditioning apparatus 1. In other words, stagnation of the refrigerant can be prevented.

[Cooling Operation: Action 3]

Herein, a third action performed when the load in the cooling operation is lower than in the second action will be described. As shown in FIG. 6, in this case, first solenoid valve 41 is "open". Second solenoid valve 42, third solenoid valve 43, and fourth solenoid valve 44 are "closed". First expansion valve 51 is "fully open". Second expansion valve 52 is "fully closed".

High-temperature, high-pressure gas refrigerant R discharged from compressor 5 flows through flow path 71, first four-way valve 31, and flow path 74 (first solenoid valve 41) and is then delivered to first heat exchanger 11. In first heat exchanger 11, refrigerant R is subjected to heat exchange with outdoor air to be condensed. Refrigerant R that has flowed through first heat exchanger 11 flows through flow path 75 (first expansion valve 51) and flow path 82 and is then delivered to indoor device 2 (see FIG. 1).

In indoor device 2, gaseous refrigerant R is subjected to heat exchange with indoor air and evaporates into low-pressure gas refrigerant. This heat exchange cools the room. Refrigerant R that has turned into low-pressure gas refrigerant flows through flow path 73, first four-way valve 31 or second four-way valve 32, and flow path 72 and is then delivered into compressor 5 to be compressed again. Hereinafter, this action is repeated.

In air conditioning apparatus 1 described above, when the load in the cooling operation is much lower, of heat exchanger group 10, only first heat exchanger 11 is used and second heat exchanger 12 and third heat exchanger 13 are not used. As a result, the cooling operation according to a lower load is performed to maintain the compression ratio of compressor 5, allowing compressor 5 to discharge desired high-temperature, high-pressure refrigerant R.

In third four-way valve 33, flow path 71 and flow path 78 are closed not to be connected to each other. This prevents high-pressure refrigerant R from flowing into third heat exchanger 13. In second four-way valve 32, flow path 71 and flow path 76 are closed not to be connected to each other. This prevents high-pressure refrigerant R from flowing into second heat exchanger 12. Consequently, refrigerant R can be prevented from remaining in third heat exchanger 13 and second heat exchanger 12, thus preventing a lack of a required amount of refrigerant as air conditioning apparatus 1. In other words, stagnation of the refrigerant can be prevented.

When the performance of heat exchanger group 10 or the like is reduced by reducing the volume of air, the volume of air may increase conversely when, for example, a gale blows. In such a case, it is assumed that a desired compression ratio cannot be obtained because the performance of the heat exchanger group increases. In heat exchanger group 10 of the air conditioning apparatus described above, an increase in the performance of the heat exchanger group can be minimized owing to the division into three heat exchangers, namely, first heat exchanger 11 to third heat exchanger 13.

[Heating Operation: Action 2]

A second action of the second operation (heating operation) of causing heat exchanger group 10 to operate as an evaporator will now be described as the action of air conditioning apparatus 1 described above.

When the air conditioning apparatus is operated, the temperature of the refrigerant that has flowed through each heat exchanger such as a first heat exchanger needs to have the same degree of dryness or to be set to a superheat for efficient operation.

When liquid refrigerant R does not remain in accumulator 6, the refrigerant outlet of the heat exchanger group functioning as an evaporator is normally dry. In such a case, the degree of opening of first expansion valve 51 and the degree of opening of second expansion valve 52 are adjusted such the temperature of the refrigerant that has flowed through each of first heat exchanger 11 to third heat exchanger 13 is the same temperature.

As shown in FIG. 7, in this case, first solenoid valve 41, third solenoid valve 43, and fourth solenoid valve 44 are "open". Second solenoid valve 42 is "closed". The degrees of opening are adjusted in first expansion valve 51 and second expansion valve 52.

High-temperature, high-pressure gaseous Refrigerant R discharged from compressor 5 flows through flow path 71, first four-way valve 31, and flow path 73 and is then delivered to indoor device 2 (see FIG. 1). In indoor device 2, gaseous refrigerant R is subjected to heat exchange with indoor air and is condensed into high-pressure liquid refrigerant. This heat exchange heats the room. Refrigerant R that has turned into liquid refrigerant is turned into two-phase refrigerant including low-pressure gas refrigerant and liquid refrigerant by a throttle device (not shown), and flows through flow path 82 and is then delivered to outdoor device 3.

Refrigerant R delivered to outdoor device 3 is divided to flow path 75 and flow path 80. At this time, the flow rate of refrigerant R flowing through flow path 75 is determined by the degree of opening of first expansion valve 51. The flow rate of refrigerant R flowing through flow path 80 is determined by the degree of opening of second expansion valve 52. Each degree of opening will be described below.

Refrigerant R that has flowed through flow path 75 (first expansion valve 51) is delivered to first heat exchanger 11. Refrigerant R that has flowed through flow path 80 (second expansion valve 52) is further divided to flow path 77 and flow path 79. Refrigerant R that has flowed through flow path 77 (third solenoid valve 43) is delivered to second heat exchanger 12. Refrigerant R that has flowed through flow path 79 (fourth solenoid valve 44) is delivered to third heat exchanger 13.

First heat exchanger 11 performs heat exchange between refrigerant R and outdoor air, so that two-phase refrigerant R evaporates into gas refrigerant. Second heat exchanger 12 performs heat exchange between refrigerant R and outdoor air, so that two-phase refrigerant R evaporates into gas refrigerant. Third heat exchanger 13 performs heat exchange between refrigerant R and outdoor air, so that two-phase refrigerant R evaporates into gas refrigerant.

Refrigerant R that has flowed through first heat exchanger 11 flows through flow path 74 (first solenoid valve 41) and first four-way valve 31. Refrigerant R that has flowed through second heat exchanger 12 flows through flow path 76 and second four-way valve 32. Refrigerant R that has flowed through third heat exchanger 13 flows through flow path 78 and third four-way valve 33.

After refrigerant R flows through first four-way valve 31, a temperature (temperature T1) of refrigerant R is measured at a measurement point P1. After refrigerant R flows through second four-way valve 32, a temperature (temperature T2) of refrigerant R is measured at a measurement point P2. After refrigerant R flows through third four-way valve 33, a temperature (temperature T3) of refrigerant R is measured at a measurement point P3.

In air conditioning apparatus 1, the degree of opening of first expansion valve 51 and the degree of opening of second expansion valve 52 are adjusted such that a temperature difference between the measured temperature T1 and a saturation temperature Ts at a low-pressure-side pressure Ps (near an accumulator ACC) of compressor 5, a temperature difference between the measured temperature T2 and saturation temperature Ts at low-pressure-side pressure Ps, and a temperature difference between the measured temperature T3 and saturation temperature Ts at low-pressure-side pressure Ps are equal to one another.

Refrigerant R that has flowed through first four-way valve 31, refrigerant R that has flowed through second four-way valve 32, and refrigerant R that has flowed through third four-way valve 33 meet, and the resultant refrigerant R flows through flow path 72. Refrigerant R flowing through flow path 72 is delivered into compressor 5 via accumulator 6 to be compressed again. Hereinafter, this action is repeated.

Air conditioning apparatus 1 described above adjusts the degree of opening of first expansion valve 51 and the degree of opening of second expansion valve 52 such that the temperature of the refrigerant that has flowed through each of first heat exchanger 11, second heat exchanger 12, and third heat exchanger 13 has the same temperature. This improves the performance of heat exchanger group 10 as an evaporator.

Assumed here is a case in which when refrigerant (liquid refrigerant) does not remain in accumulator 6, that is, when the outlet of heat exchanger group 10 of outdoor device 3 is superheated, the degree of opening of first expansion valve 51 and the degree of opening of second expansion valve 52 are set to the same degree of opening.

In that case, refrigerant of 50% of the refrigerant amount to be delivered to outdoor device 3 flows through first heat exchanger 11. Refrigerant of 25% of the refrigerant amount to be delivered to outdoor device 3 flows through second heat exchanger 12. Refrigerant of 25% of the refrigerant amount to be delivered to outdoor device 3 flows through third heat exchanger 13.

Then, the occurrence of the following unfavorable situation is assumed: although the refrigerant that has flowed through second heat exchanger 12 and the refrigerant that has flowed through third heat exchanger 13 are delivered in the same superheated state, the refrigerant that has flowed through first heat exchanger 11 is delivered with a smaller superheat than that of the above refrigerant, further, delivered in a wet state including liquid refrigerant.

In air conditioning apparatus 1 described above, when liquid refrigerant R does not remain in accumulator 6, the degree of opening of first expansion valve 51 and the degree of opening of second expansion valve 52 are adjusted such that the values of the respective superheats are constant. Consequently, refrigerant R of 33% (⅓) of the refrigerant amount to be delivered to outdoor device 3 flows through each of first heat exchanger 11, second heat exchanger 12, and third heat exchanger 13.

As a result, refrigerant R that has flowed through each of first heat exchanger 11, second heat exchanger 12, and third heat exchanger 13 can be delivered in the same dry state, thus improving the performance of heat exchanger group 10 as an evaporator. Also, when refrigerant (liquid refrigerant) remains in accumulator 6, a superheat at the outlet of heat exchanger group 10 can be provided to the refrigerant less easily. Thus, adjusting the degree of opening of first expansion valve 51 to about a half of a Cv value (capacity coefficient) of the degree of opening of second expansion valve 52 can achieve the effects similar to those achieved when the refrigerant (liquid refrigerant) does not remain in accumulator 6.

Although the case in which air conditioning apparatus 1 described above measures the temperature of refrigerant R at measurement point P2 and the temperature of refrigerant R at measurement point P3 has been described above, air conditioning apparatus 1 may measure the temperature at any one of measurement point P2 and measurement point P3.

[Heating Operation: Action 3]

The following will describe a third action of the second operation (heating operation) of causing heat exchanger group 10 to operate as an evaporator when air conditioning apparatus 1 described above includes a plurality of outdoor units.

A non-limiting example of the air conditioning apparatus is an air conditioning apparatus including a plurality of outdoor units as an outdoor device, such as a multi-air conditioner for building. Herein, an air conditioning apparatus including such outdoor units will be described as an example.

FIG. 8 shows an air conditioning apparatus 1 including at least a first outdoor unit 4*a* and a second outdoor unit 4*b* as outdoor unit 4 of outdoor device 3. Each of first outdoor unit 4*a* and second outdoor unit 4*b* has the same configuration as that of outdoor unit 4 shown in FIG. 1. Thus, the same components are denoted by the same references, and description thereof will not be repeated unless otherwise required.

Heat exchanger group 10 of first outdoor unit 4*a* is a first heat exchanger group, and heat exchanger group 10 of second outdoor unit 4*b* is a second heat exchanger group. An accumulator provided in first outdoor unit 4*a* is a first accumulator, and an accumulator provided in second outdoor unit 4*b* is a second accumulator.

A refrigerant flow in each of first outdoor unit 4*a* and second outdoor unit 4*b* when heat exchanger group 10 is caused to operate as an evaporator is basically the same as the refrigerant flow described with reference to FIG. 4. The refrigerant flow will accordingly be described briefly.

High-temperature, high-pressure refrigerant R discharged from compressor 5 of first outdoor unit 4*a* and high-pressure refrigerant R discharged from compressor 5 of second outdoor unit 4*b* flow through flow paths 71 and flow paths 73 and meet at flow path 90. The resultant refrigerant R is delivered to indoor device 2 and subjected to heat exchange with indoor air, and subsequently flows through flow path 91. Refrigerant R is divided while flowing through flow path 91 and then flows through flow path 82 of first outdoor unit 4*a* or flow path 82 of second outdoor unit 4*b*.

In first outdoor unit 4*a*, refrigerant R flowing through flow path 82 is divided to flow path 75 and flow path 80. At this time, the flow rate of refrigerant R flowing through flow path 75 is determined by the degree of opening of first expansion valve 51. The flow rate of refrigerant R flowing through flow path 80 is determined by the degree of opening of second expansion valve 52. Each degree of opening will be described below.

Refrigerant R that has flowed through flow path 75 (first expansion valve 51) is delivered to first heat exchanger 11. Refrigerant R that has flowed through flow path 80 (second expansion valve 52) is divided to flow path 77 and flow path 79. Refrigerant R that has flowed through flow path 77 (third solenoid valve 43) is delivered to second heat exchanger 12. Refrigerant R that has flowed through flow path 79 (fourth solenoid valve 44) is delivered to third heat exchanger 13.

First heat exchanger 11 performs heat exchange between refrigerant R and outdoor air. Second heat exchanger 12 performs heat exchange between refrigerant R and outdoor air. Third heat exchanger 13 performs heat exchange between refrigerant R and outdoor air. Refrigerant R subjected to heat exchange in first heat exchanger 11 flows through flow path 74 (first solenoid valve 41) and first four-way valve 31. Refrigerant R subjected to heat exchange in second heat exchanger 12 flows through flow path 76 and second four-way valve 32. Refrigerant R subjected to heat exchange in third heat exchanger 13 flows through flow path 78 and third four-way valve 33.

Refrigerant R that has flowed through first four-way valve 31, refrigerant R that has flowed through second four-way valve 32, and refrigerant R that has flowed through third four-way valve 33 meet, and the resultant refrigerant R flows through flow path 72. Refrigerant R flowing through flow path 72 is delivered into compressor 5 via accumulator 6 to be compressed again. Hereinafter, first outdoor unit 4*a* repeats this action.

In second outdoor unit 4*b*, refrigerant R flowing through flow path 82 is divided to flow path 75 and flow path 80. At this time, the flow rate of refrigerant R flowing through flow path 75 is determined by the degree of opening of first expansion valve 51. The flow rate of refrigerant R flowing through flow path 80 is determined by the degree of opening of second expansion valve 52. Each degree of opening will be described below.

Refrigerant R that has flowed through flow path 75 (first expansion valve 51) is delivered to first heat exchanger 11. Refrigerant R that has flowed through flow path 80 (second expansion valve 52) is divided to flow path 77 and flow path 79. Refrigerant R that has flowed through flow path 77 (third solenoid valve 43) is delivered to second heat exchanger 12. Refrigerant R that has flowed through flow path 79 (fourth solenoid valve 44) is delivered to third heat exchanger 13.

First heat exchanger 11 performs heat exchange between refrigerant R and outdoor air. Second heat exchanger 12 performs heat exchange between refrigerant R and outdoor air. Third heat exchanger 13 performs heat exchange between refrigerant R and outdoor air. Refrigerant R subjected to heat exchange in first heat exchanger 11 flows through flow path 74 (first solenoid valve 41) and first four-way valve 31. Refrigerant R subjected to heat exchange in second heat exchanger 12 flows through flow path 76 and second four-way valve 32. Refrigerant R subjected to heat exchange in third heat exchanger 13 flows through flow path 78 and third four-way valve 33.

Refrigerant R that has flowed through first four-way valve 31, refrigerant R that has flowed through second four-way valve 32, and refrigerant R that has flowed through third four-way valve 33 meet, and the resultant refrigerant R flows through flow path 72. Refrigerant R flowing through flow path 72 is delivered into compressor 5 via accumulator 6 to be compressed again. Hereinafter, second outdoor unit 4*b* repeats this action.

In each of first outdoor unit 4*a* and second outdoor unit 4*b* of air conditioning apparatus 1 described above, accumulator 6 is connected to the inlet side of compressor 5. When heat exchanger group 10 is caused to operate (heating operation) as an evaporator, liquid refrigerant is normally stored in accumulator 6.

As described above, in the heating operation, the refrigerant that has flowed through indoor device 2 is divided and is then delivered to first outdoor unit 4*a* or second outdoor unit 4*b*. In first outdoor unit 4*a*, the refrigerant flows through heat exchanger group 10 and is then delivered to the inlet side of compressor 5 via accumulator 6. Also in second outdoor unit 4*b*, the refrigerant flows through heat exchanger group 10 and is then delivered to the inlet side of compressor 5 via accumulator 6.

When a plurality of outdoor units 4, such as first outdoor unit 4*a* and second outdoor unit 4*b*, are disposed, the pressure of the refrigerant to be divided may differ depending on the position at which the refrigerant that has flowed through indoor device 2 is divided. Consequently, the amount of refrigerant R divided from flow path 91 to be delivered to first outdoor unit 4*a* may differ from the amount of refrigerant R divided from flow path 91 to be delivered to second outdoor unit 4*b*. In other words, refrigerant R may not be distributed evenly to first outdoor unit 4*a* and second outdoor unit 4*b*.

At this time, the following is assumed: if the amount of refrigerant R to be delivered to first outdoor unit 4*a* is relatively large, the amount of the liquid refrigerant of accumulator 6 of first outdoor unit 4*a* increases to be full, causing the liquid refrigerant to flow into compressor 5, which may damage compressor 5.

Air conditioning apparatus 1 described above adjusts the amount of refrigerant R to be delivered to first outdoor unit 4*a* and the amount of refrigerant R to be delivered to second outdoor unit 4*b* such that the amount of liquid refrigerant of accumulator 6 disposed in each of first outdoor unit 4*a* and second outdoor unit 4*b* is the same amount, for example, such that the same fluid level is obtained by a fluid level detector inserted into accumulator 6 or the same value of a discharge superheat of compressor 5 is obtained in first outdoor unit 4*a* and second outdoor unit 4*b*.

In other words, the degree of opening of first expansion valve 51 and the degree of opening of second expansion valve 52 of each of first outdoor unit 4*a* and second outdoor unit 4*b* are adjusted such that refrigerant R to be divided has the same amount.

The same amount of refrigerant R is delivered to each of first outdoor unit 4*a* and second outdoor unit 4*b*, and accordingly, the liquid refrigerant of accumulator 6 has the same amount, thus preventing malfunctions such as damage to compressor 5.

Embodiment 2

[Configuration]

Figure 9:
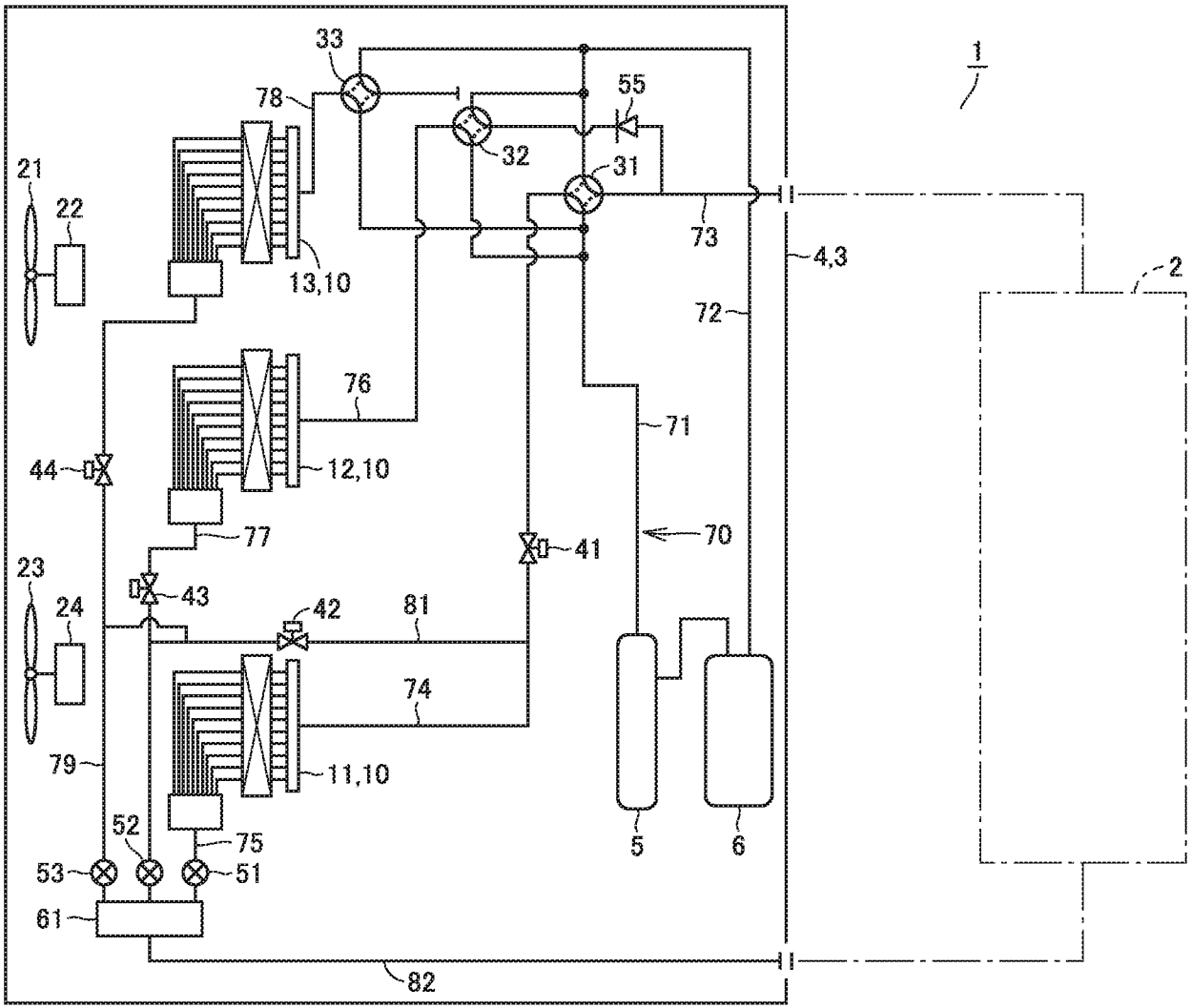
FIG. 9 shows a configuration of an air conditioning apparatus including an outdoor device according to Embodiment 2, which includes a refrigerant circuit.

An air conditioning apparatus according to Embodiment 2 will be described. As shown in FIG. 9, air conditioning apparatus 1 is provided with a three-way distributor 61 that divides refrigerant into three. Three-way distributor 61 is connected with flow path 75 connected to first heat exchanger 11, flow path 77 connected to second heat exchanger 12, and flow path 79 connected to third heat exchanger 13, and is also connected with flow path 82 connected to indoor device 2.

Figure 10:
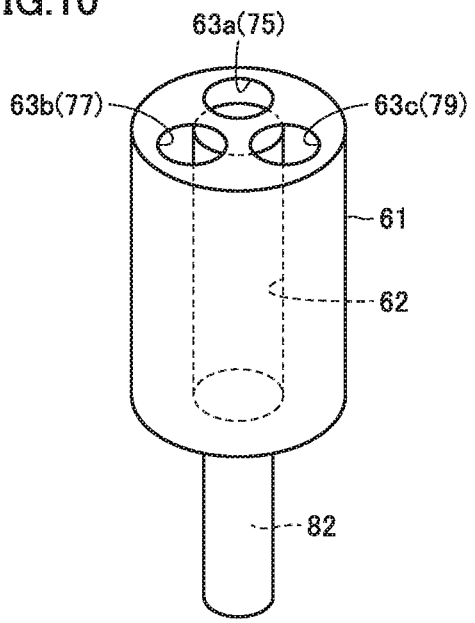
FIG. 10 is an enlarged perspective view showing an example of a three-way distributor for use in the outdoor device according to Embodiment 2.

As shown in FIG. 10, three openings 63*a*, 63*b*, and 63*c* are formed equidistantly on the circumference of three-way distributor 61 on one end side of hollow tube 62. Each of openings 63*a*, 63*b*, and 63*c* communicates with the hollow portion of hollow tube 62. For example, flow path 75 is connected to opening 63*a*, flow path 77 is connected to opening 63*b*, and flow path 79 is connected to opening 63*c*. Flow path 82 is connected to the other end side of hollow tube 62.

First expansion valve 51 is provided in flow path 75. Second expansion valve 52 is provided in flow path 77. Third expansion valve 53 is provided in flow path 79. Flow path 81 is connected to flow path 77 and flow path 79. Since the other configuration is similar to that of air conditioning apparatus 1 shown in FIG. 1, the same components are denoted by the same references, and description thereof will not be repeated unless otherwise required.

[Heating Operation: Action 1]

A second operation (heating operation) of causing heat exchanger group 10 to operate as an evaporator will be described as the action of air conditioning apparatus 1 according to Embodiment 2.

Figure 11:
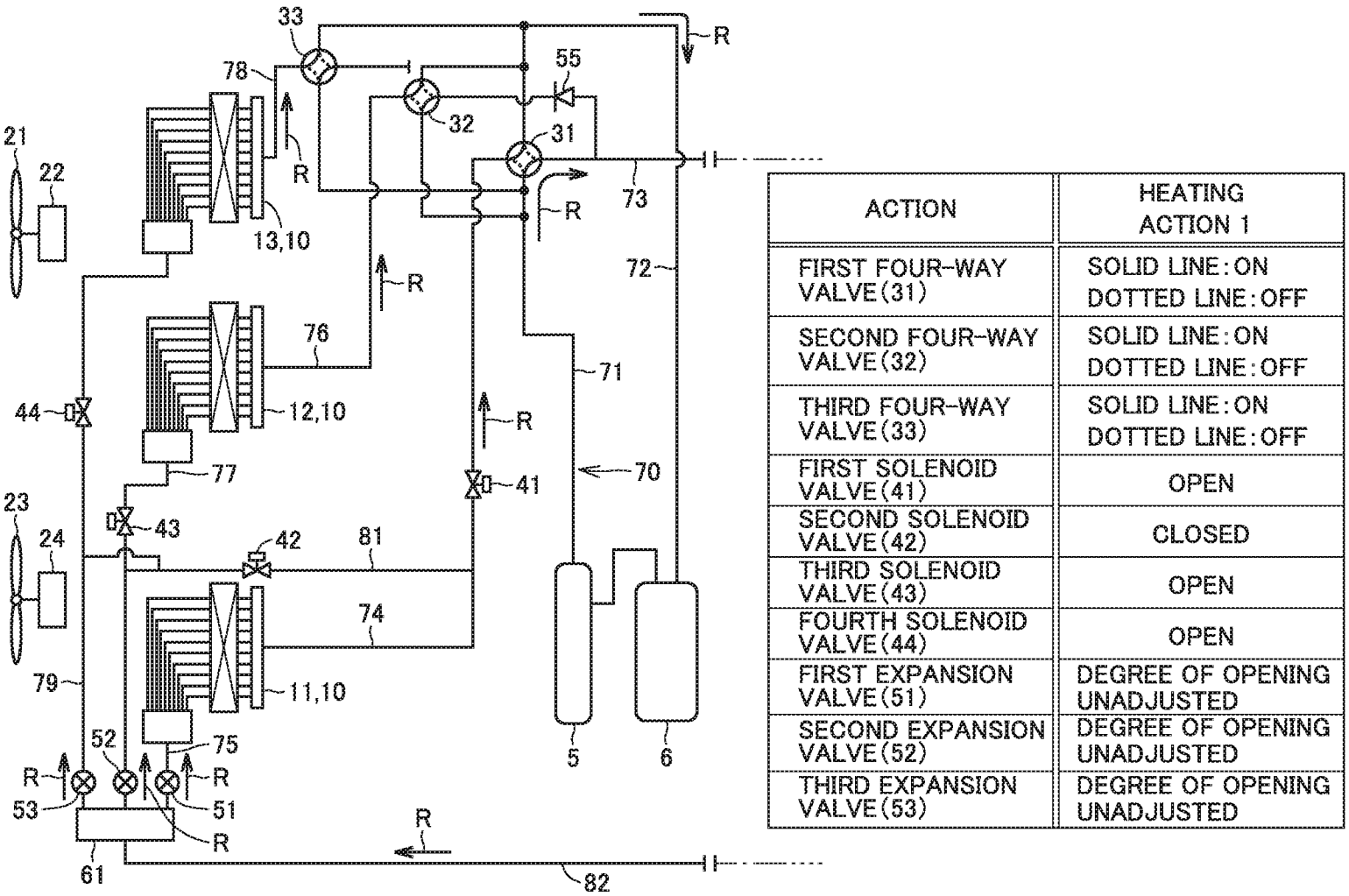
FIG. 11 shows a flow of refrigerant for illustrating a fourth example of the heating operation in Embodiment 2.

As shown in FIG. 11, in this case, first solenoid valve 41, third solenoid valve 43, and fourth solenoid valve 44 are "open". Second solenoid valve 42 is "closed". The degrees of opening of first expansion valve 51, second expansion valve 52, and third expansion valve 53 are not particularly adjusted.

High-temperature, high-pressure gaseous refrigerant R discharged from compressor 5 flows through flow path 71, first four-way valve 31, and flow path 73 and is then delivered to indoor device 2 (see FIG. 1). In indoor device 2, refrigerant R is subjected to heat exchange with indoor air to be compressed into high-pressure liquid refrigerant. This heat exchange heats the room. Refrigerant R that has turned into liquid refrigerant is turned into two-phase refrigerant including low-pressure gas refrigerant and liquid refrigerant by a throttle device (not shown), and flows through flow path 82 and is then delivered to outdoor device 3.

In outdoor device 3, refrigerant R that has flowed through flow path 82 is divided equally to three paths, namely, flow path 75, flow path 77, and flow path 79 by three-way distributor 61. Refrigerant R that has flowed through flow path 75 (first expansion valve 51) is delivered to first heat exchanger 11. Refrigerant R that has flowed through flow path 77 (second expansion valve 52) is delivered to second heat exchanger 12. Refrigerant R that has flowed through flow path 79 (third expansion valve 53) is delivered to third heat exchanger 13.

First heat exchanger 11 performs heat exchange between refrigerant R and outdoor air, so that two-phase refrigerant R evaporates into gas refrigerant. Second heat exchanger 12 performs heat exchange between refrigerant R and outdoor air, so that two-phase refrigerant R evaporates into gas refrigerant. Third heat exchanger 13 performs heat exchange between refrigerant R and outdoor air, so that two-phase refrigerant R evaporates into gas refrigerant.

Refrigerant R that has flowed through first heat exchanger 11 flows through flow path 74 (first solenoid valve 41) and first four-way valve 31. Refrigerant R that has flowed through second heat exchanger 12 flows through flow path 76 and second four-way valve 32. Refrigerant R that has flowed through third heat exchanger 13 flows through flow path 78 and third four-way valve 33.

Refrigerant R that has flowed through first four-way valve 31, refrigerant R that has flowed through second four-way valve 32, and refrigerant R that has flowed through third four-way valve 33 meet, and the resultant refrigerant R flows through flow path 72. Refrigerant R flowing through flow path 72 is delivered into compressor 5 via accumulator 6 to be compressed again. Hereinafter, this operation is repeated.

In air conditioning apparatus 1 described above, refrigerant R delivered from indoor device 2 is divided equally to three paths, namely, flow path 75, flow path 77, and flow path 79 by three-way distributor 61. This allows the same amount of refrigerant to be delivered to each of first heat exchanger 11, second heat exchanger 12, and third heat exchanger 13 without adjusting the degrees of opening of first expansion valve 51, second expansion valve 52, and third expansion valve 53. Consequently, refrigerant can evaporate efficiently, thus improving the evaporation performance of heat exchanger group 10 serving as an evaporator.

[Heating Operation: Action 2]

A second action performed when the load in the second operation (heating operation) of causing heat exchanger group 10 to operate as an evaporator is low will now be described. Specifically, a low-load heating operation refers to a heating operation at a relatively high temperature of the outdoor air, where a compressor frequency is low.

As shown in FIG. 12, in this case, first solenoid valve 41 is "closed". Second solenoid valve 42, third solenoid valve 43, and fourth solenoid valve 44 are "open". The degree of opening of first expansion valve 51 is "fully open". The degrees of opening of second expansion valve 52 and third expansion valve 53 are "fully closed".

High-temperature, high-pressure gaseous refrigerant R discharged from compressor 5 flows through flow path 71, first four-way valve 31, and flow path 73 and is then delivered to indoor device 2 (see FIG. 1). In indoor device 2, refrigerant R is subjected to heat exchange with indoor air, and is compressed into high-pressure liquid refrigerant. This heat exchange heats the room. Refrigerant R that has turned into liquid refrigerant is turned into two-phase refrigerant including low-pressure gas refrigerant and liquid refrigerant by a throttle device (not shown), and flows through flow path 82 and is then delivered to outdoor device 3.

In outdoor device 3, refrigerant R that has flowed through flow path 82 flows through three-way distributor 61 and first expansion valve 51, and flows only into flow path 75. Refrigerant R that has flowed through flow path 75 is delivered to first heat exchanger 11. First heat exchanger 11 performs heat exchange between refrigerant R and outdoor air. Refrigerant R that has flowed through first heat exchanger 11 flows through flow path 74 and flow path 81 (second solenoid valve 42) and is subsequently divided to two paths, namely, flow path 77 and flow path 79.

Refrigerant R that has flowed through flow path 77 (third solenoid valve 43) is delivered to second heat exchanger 12. Refrigerant R that has flowed through flow path 79 (fourth solenoid valve 44) is delivered to third heat exchanger 13. Second heat exchanger 12 performs heat exchange between refrigerant R and outdoor air. Third heat exchanger 13 performs heat exchange between refrigerant R and outdoor air.

Refrigerant R that has been subjected to heat exchange in second heat exchanger 12 flows through flow path 76 and second four-way valve 32. Refrigerant R that has been subjected to heat exchange in third heat exchanger 13 flows through flow path 78 and third four-way valve 33. Refrigerant R that has flowed through second four-way valve 32 and refrigerant R that has flowed through third four-way valve 33 meet, and the resultant refrigerant R flows through flow path 72. Refrigerant R flowing through flow path 72 is delivered into compressor 5 via accumulator 6 to be compressed again. Hereinafter, this action will be repeated.

In air conditioning apparatus 1 described above, refrigerant R delivered from indoor device 2 flows through first heat exchanger 11 and is subsequently divided into two, where one refrigerant flows through second heat exchanger 12 and the other refrigerant flows through third heat exchanger 13. At this time, the path number of refrigerant paths through which refrigerant R flows is a path number 2PN twice the path number PN. This reduces the flow velocity of refrigerant R.

The characteristics of a pressure loss against a degree of dryness will now be described. A pressure loss normally increases as a degree of dryness increases. In air conditioning apparatus 1, two-phase refrigerant having a degree of dryness of about 0.2 flows through first heat exchanger 11, and then, the refrigerant whose flow velocity has decreased and which has been divided into two flows through the second heat exchanger and the third heat exchanger. This minimizes an increase in pressure loss.

The respective embodiments have described the example in which three equal heat exchangers, namely, first heat exchanger 11, second heat exchanger 12, and third heat exchanger 13 are the heat exchangers of heat exchanger group 10. However, these heat exchangers do not necessarily need to be equal to one another, and may include a heat exchanger with a different physical structure, such as a difference size or a different path number of refrigerant paths.

Although the respective embodiments have described three heat exchangers as examples of the heat exchangers of heat exchanger group 10, three heat exchangers do not necessarily need to be provided. When a plurality of (third number of) heat exchangers are connected in series, if the number of (second number of) heat exchangers through which refrigerant flows later is smaller than the number of (first number of) parallel-connected heat exchangers through which refrigerant flows first, similar effects can be achieved. The first number, second number, and third number are natural numbers, and the third number is a sum of the first number and the second number.

The air conditioning apparatuses described in the respective embodiments can be combined with each other in various manners as required. Also, the respective embodiments are applicable not only to air conditioning apparatuses but also to refrigerant cycle apparatuses having a refrigeration cycle, such as refrigerators and freezers.

The embodiments disclosed herein have been presented for the purpose of illustration and non-restrictive in every respect. It is therefore intended that the scope of the present invention is defined by claims, not only by the embodiments described above, and encompasses all modifications and variations equivalent in meaning and scope to the claims.

INDUSTRIAL APPLICABILITY

The present invention is effectively used in a refrigerant cycle apparatus including a heat exchanger group including a plurality of heat exchangers and in an air conditioning apparatus including the refrigerant cycle apparatus.

The invention claimed is:

1. A refrigerant cycle apparatus comprising:

an outdoor device comprising a heat exchanger group comprising a first heat exchanger, a second heat exchanger, and a third heat exchanger; and a refrigerant circuit in which the heat exchanger group is connected by a pipe, wherein in a first operation of causing the heat exchanger group to operate as a condenser, refrigerant flowing inside the pipe flows through the second heat exchanger and the third heat exchanger connected in parallel and then flows through the first heat exchanger, in a second operation of causing the heat exchanger group to operate as an evaporator, refrigerant flowing inside the pipe flows through the first heat exchanger, the second heat exchanger, and the third heat exchanger connected in parallel, the refrigerant cycle apparatus further comprises:

a first expansion valve for adjusting an amount of refrigerant flowing to the first heat exchanger in the second operation; and a second expansion valve for adjusting an amount of refrigerant flowing to the second heat exchanger and the third heat exchanger in the second operation, the outdoor device comprises a first unit and a second unit, the first unit comprises a first heat exchanger group comprising the first heat exchanger, the second heat exchanger, and the third heat exchanger serving as the heat exchanger group, the second unit comprises a second heat exchanger group comprising a first heat exchanger, a second heat exchanger, and a third heat exchanger, in the second unit, in the second operation, the first heat exchanger of the second heat exchanger group, the second heat exchanger of the second heat exchanger group, and the third heat exchanger of the second heat exchanger group are connected in parallel, and the second unit comprises a first expansion valve for adjusting an amount of the refrigerant flowing into the first heat exchanger of the second heat exchanger group, and a second expansion valve for adjusting an amount of the refrigerant flowing into the second heat exchanger of the second heat exchanger group and the third heat exchanger of the second heat exchanger group.

2. The refrigerant cycle apparatus according to claim 1, wherein in the first operation, any one of the second heat exchanger of the first unit and the third heat exchanger of the first unit is stopped or both of the second heat exchanger of the first unit and the third heat exchanger of the first unit are stopped in accordance with a load in the first operation.

3. The refrigerant cycle apparatus according to claim 1, wherein a temperature of refrigerant flowing through the first heat exchanger of the first unit, a temperature of refrigerant flowing through the second heat exchanger of the first unit, and a temperature of refrigerant flowing through the third heat exchanger of the first unit are equal to one another.

4. The refrigerant cycle apparatus according to claim 1, wherein the first operation comprises a first action, which is performed when a load in the first operation is higher than a load during a second action, and the second action, which is performed when the load in the first operation is lower than the load during the first action, and in the second action, the refrigerant delivered to the heat exchanger group does not flow into the third heat exchanger of the first unit and flows through the second heat exchanger of the first unit and then flows through the first heat exchanger of the first unit.

5. The refrigerant cycle apparatus according to claim 4, wherein the first operation comprises a third action performed when the load in the first operation is lower than in the second action, and in the third action, the refrigerant delivered to the heat exchanger group does not flow into the second heat exchanger of the first unit and the third heat exchanger of the first unit and flows through the first heat exchanger of the first unit.

6. The refrigerant cycle apparatus according to claim 1, wherein the outdoor device comprises a compressor, and in the second operation, a first temperature difference between a temperature of the refrigerant after flowing through the first heat exchanger of the first unit and a saturation temperature at a pressure on a suction side of the compressor, a second temperature difference between a temperature of the refrigerant after flowing through the second heat exchanger of the first unit and the saturation temperature, and a third temperature difference between a temperature of the refrigerant after flowing through the third heat exchanger of the first unit and the saturation temperature are equal to one another.

7. The refrigerant cycle apparatus according to claim 1, wherein the first unit comprises a first accumulator connected to the first heat exchanger group and configured to store the refrigerant, the second unit comprises a second accumulator connected to the second heat exchanger group and configured to store the refrigerant, and an amount of the refrigerant flowing from the first heat exchanger group to the first accumulator is equal to an amount of the refrigerant flowing from the second heat exchanger group to the second accumulator.

8. An air conditioning apparatus comprising a refrigerant cycle apparatus according to claim 1.

9. A refrigerant cycle apparatus comprising:

an outdoor device comprising a heat exchanger group comprising a first heat exchanger, a second heat exchanger, and a third heat exchanger; and a refrigerant circuit in which the heat exchanger group is connected by a pipe, wherein in a first operation of causing the heat exchanger group to operate as a condenser, refrigerant flowing inside the pipe flows through the second heat exchanger and the third heat exchanger connected in parallel and then flows through the first heat exchanger, in a second operation of causing the heat exchanger group to operate as an evaporator, refrigerant flowing inside the pipe flows through the first heat exchanger, the second heat exchanger, and the third heat exchanger connected in parallel, the refrigerant cycle apparatus further comprises:

a first expansion valve for adjusting an amount of the refrigerant flowing to the first heat exchanger in the second operation, a second expansion valve for adjusting an amount of the refrigerant flowing to the second heat exchanger in the second operation, and a third expansion valve for adjusting an amount of the refrigerant flowing to the third heat exchanger in the second operation, in the second operation, in a heating operation at low load, the refrigerant flowing inside the pipe flows through the first heat exchanger and then flows through the second heat exchanger and the third heat exchanger connected in parallel.

10. An air conditioning apparatus comprising a refrigerant cycle apparatus according to claim 9.

* * * * *